US006592288B2

(12) United States Patent
Chun

(10) Patent No.: US 6,592,288 B2
(45) Date of Patent: Jul. 15, 2003

(54) HIGH-TRACTION ANTI-ICING ROADWAY COVER SYSTEM

(76) Inventor: Joong H. Chun, 5205 Brougham La., Plano, TX (US) 75023

( * ) Notice: Subject to any disclaimer, the term of this patent is extended or adjusted under 35 U.S.C. 154(b) by 50 days.

(21) Appl. No.: 09/982,403

(22) Filed: Oct. 18, 2001

(65) Prior Publication Data

US 2003/0077121 A1 Apr. 24, 2003

(51) Int. Cl.[7] ..... G01C 13/02

(52) U.S. Cl. ..... 404/71; 404/19; 404/31; 404/36; 238/14

(58) Field of Search ..... 404/19, 27, 28, 404/32, 34, 35, 36, 71, 77, 79; 238/14

(56) References Cited

U.S. PATENT DOCUMENTS

| | | | | |
|---|---|---|---|---|
| 3,575,255 A | | 4/1971 | Wickstrom | |
| 3,629,551 A | | 12/1971 | Ando | |
| 3,995,965 A | | 12/1976 | Cox | 404/71 |
| 4,146,635 A | | 3/1979 | Eigenmann | 428/283 |
| 4,646,818 A | * | 3/1987 | Ervin, Jr. | 165/103 |
| 4,880,051 A | | 11/1989 | Ohashi | |
| 5,024,553 A | * | 6/1991 | Katsuragi | 404/71 |
| 5,077,117 A | * | 12/1991 | Harper et al. | 428/143 |
| 5,204,159 A | | 4/1993 | Tan | 428/143 |
| 5,316,406 A | | 5/1994 | Wyckoff | 414/12 |
| 5,683,619 A | | 11/1997 | Ossian et al. | |
| 5,762,447 A | | 6/1998 | Hachiki et al. | |
| 5,853,846 A | | 12/1998 | Clark et al. | |
| 5,966,502 A | * | 10/1999 | Pearce | 392/465 |
| 6,184,496 B1 | | 2/2001 | Pearce | |
| 6,303,241 B1 | | 10/2001 | Miles | |

FOREIGN PATENT DOCUMENTS

DE 27 02 442 A1 7/1978

OTHER PUBLICATIONS

"Heated Bridge Technology", Publication No. FHWA–RD–99–158 (U.S. Dept. of Transportation, Federal Highway Administration, Jul. 1999).

"Road surface for frozen ground—has additional heat insulation laid on mail insulation", abstract of patent SU 101889–A1 (Derwent, 1993).

"VDOT's Hot Bridge—Heated Bridge Deck on Route 60" (Virginia Department of Transportation), http://www.vdot-.state.va.us/info/hotbridge.html.

(List continued on next page.)

*Primary Examiner*—Thomas B. Will
*Assistant Examiner*—Raymond W Addie
(74) *Attorney, Agent, or Firm*—Anderson, Levine & Lintel

(57) ABSTRACT

A high traction anti-icing road cover system; the system includes a pair of base magnetic covers, for example steel plates or flexible non-porous magnetic layers, disposed in grooves in a road surface, such as a bridge span or deck, along the expected tire tracks followed by vehicles. A road cover is constructed of a lamination of a flexible non-porous magnetic layer, an intermediate thermal insulating layer and a tube layer including a plurality of bonded parallel tubes. The plurality of tubes extend obliquely across the width of each road cover. Most of the tubes contain a substance that collapses upon the temperature falling below about freezing; other tubes remain extended above the collapsed surface, to provide better traction in the event of icing of the road surface. All of the tubes are somewhat deformable by the weight of passing vehicles, which mechanically breaks forming ice. Selected tubes may contain a heating coil, coupled to a switch that controllably applies current thereto. Other tubes have their interiors coupled to a supply of anti-icing chemical fluid, and orifices at their surface, to dispense the fluid under the control of a valve that controls the amount and timing of the dispensing. A system control module is used to control the current and control valve, in response to temperature, precipitation, and ice sensors at the road surface.

29 Claims, 10 Drawing Sheets

OTHER PUBLICATIONS

"ISTEA of 1991, Section 6005 (e)7, Thin Bonded Overlay and Surface Lamination (Pavements and Bridges)" (U.S. Department of Transportation, Federal Highway Administration).

"Transportation Infrastructure: Highway Pavement Design Guide Is Outdated" (U.S. General Accounting Office, Nov. 1997).

"Ole Miss Engineer Leads in Highway Pavement Research" (University of Mississippi, Aug. 1998).

"Super Insulator" (Livermore, CA, Jul. 1996).

"Energy Management for the Third Millenium: 27$^{th}$ Century Technologies Discovers the Thermal Diode" (PR Newswire, May, 2000).

"Ice Sensor Products" (Best Idea Products, 1998), http://www.exportcentral.com/isproducts.html.

"Ice Sensor/Wet Sensor".

"The Energy Anti–Icing System".

* cited by examiner

FIG. 5a
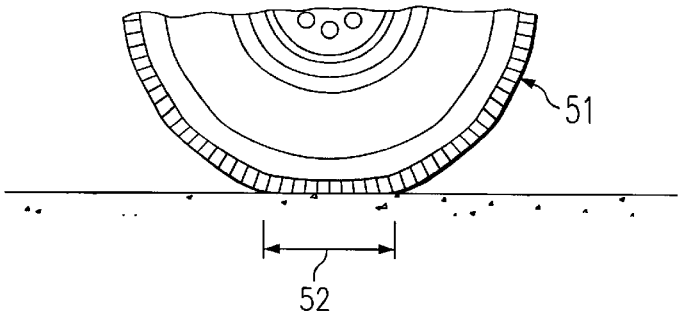
FIG. 5b
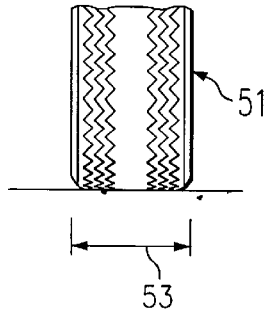
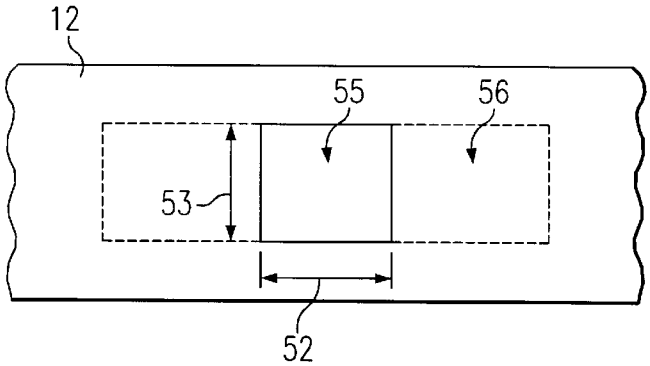
FIG. 5c
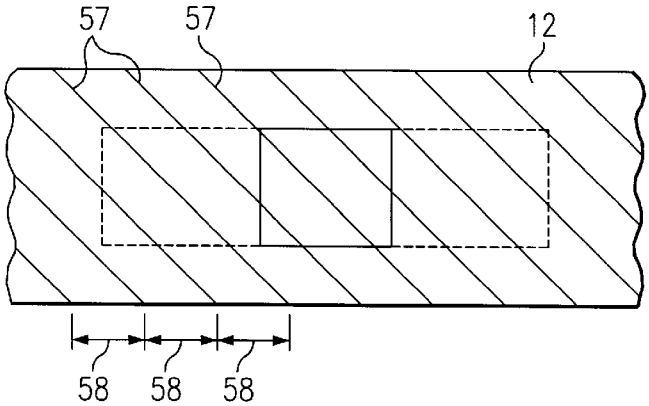
FIG. 5d
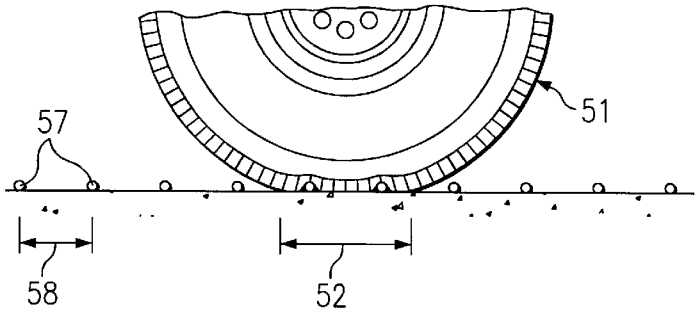
FIG. 5e

HIGH-TRACTION ANTI-ICING ROADWAY COVER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is in the field of anti-icing systems for roads and bridges, and is more specifically directed to roadway covering systems.

The icing and snow-covering of roadways is of course a well-known cause of poor vehicle traction, and thus poor driving conditions, during the winter season in many parts of the world. These poor driving conditions result in motor vehicle collisions, and also in reduced traffic flow as vehicles slow in attempting to prevent collisions.

Bridges are especially susceptible to dangerous icing, especially in souther parts of the United States, which often have temperatures around freezing, and also often receive freezing rain and sleet in winter months. An example of a particularly dangerous icing condition is referred to as "black ice". Because bridge span portions are not in direct contact with the earth, which retains heat from earlier in the day, bridges generally ice sooner than the rest of the roadways in these conditions. Accordingly, cities, states, and other road maintenance entities continue to take significant anti-icing and de-icing actions in winter to maintain or improve roadway and bridge traction. By way of definition, the term "anti-icing" often refers to actions taken prior to precipitation in order to prevent ice buildup, in contrast to the term "de-icing" which often refers to actions taken after precipitation to remove ice buildup. However, these terms are often also used interchangeably with one another. These conventional anti-icing and de-icing actions take the forms of chemical, thermal, and mechanical methods, as will now be summarized.

Anti-icing chemicals prevent ice buildup by lowering the melting temperature of water to a temperature below that of the ambient temperature, thus preventing the formation of ice. These chemicals are also used to melt ice, in the de-icing context, although with poorer efficiency than if used prior to formation of the ice. Examples of anti-icing and de-icing chemicals include the salts of sodium chloride, calcium chloride, and magnesium chloride. Of these three salts, sodium chloride is the least expensive, but is only effective to a temperature of about −12° to −18° C. Sodium chloride also involves significant environmental impact, because of its tendency to increase groundwater salinity, its undesirable effects on fragile aquatic ecosystems, and its effect of leaching soil toxins into groundwater and surface water; sodium chloride also tends to crack the top surface of concrete roadways. Calcium chloride reduces the melting temperature of water to −29° C. and is less damaging to concrete, but can be more damaging to the environment. Calcium chloride and sodium chloride are also quite corrosive to the vehicles themselves, and corrosive to the steel that is often used to reinforce concrete bridge decks. Magnesium chloride is know to reduce the melting point of water to −33° C. and is believed to be less environmentally damaging and less corrosive, but is significantly more expensive than the other salts. In addition, the dispensing of anti-icing chemicals often involves significant labor costs.

Thermal anti-icing techniques involve the heating of the roadway surface to keep its temperature above the melting point of water. For example, U.S. Pat. No. 3,995,965 discloses a heating system including ducts at the surface of the roadway for carrying heating fluid, in which the fluid is pumped in response to a vehicle passing over an actuator. In recent years, test projects have been built in Oregon and in Virginia to evaluate the heating of bridge decks. One of the Oregon projects reportedly involves the heating of a bridge deck that is over 1000 meters in length, using a mineral insulate cable. Another bridge project in Oregon evaluated the use of heated ground water that is pumped through thermoplastic tubing in the bridge deck. The Virginia Department of Transportation projects heats a bridge deck with ammonia carried by steel piping in the bridge deck; the ammonia is heated via a heat exchanger, in which the primary loop carriers a mixture of propylene glycol and water that is heated by a gas-fired furnace. In this Virginia system, a computerized control system activates the bridge heating upon detecting of snow or ice, or upon detecting freezing temperatures in combination with precipitation or a wet bridge deck; the control system also shuts down the heating cycle upon detecting safe conditions.

These conventional thermal anti-icing methods necessarily involve significant construction costs to place the cable or pipe, and are generally not very energy efficient considering that the entire bridge deck is being heated. In addition, if the hazardous conditions (i.e., wet and freezing) continue, the bridge deck continues to be heated, consuming additional energy.

Mechanical methods are generally used for de-icing, rather than anti-icing. Examples of these methods include simply the plowing and bulldozing of ice and snow on the roadways by plowing vehicles.

By way of further background, the application of anti-skid elements to road surfaces is know. A fundamental example of this approach is simply the dispensing of sand over ice and snow, to provide additional friction between the frozen surface and the tires of passing vehicles. Of course, sand and other abrasives do not themselves serve to melt ice and snow, and as such abrasives are often used in combination with chemical de-icing chemicals. Examples of such anti-skid elements, in the form of road or walkway markers or marking tape, are disclosed in U.S. Pat. No. 4,146,635, U.S. Pat. No. 5,316,406, German Patent No. DE 2702442, and U.S. Pat. No. 5,204,159. A description of heat insulation materials for frozen roads is disclosed in Soviet Union Patent No. 1010889-A1.

In recent years, significant research in the field of highway safety improvement has been funded by the United States Department of Transportation. This research includes the use of thin bonded overlays or surface laminates of highway pavements and bridge decks. Several test projects of various bonded overlays and inlays of highway surfaces, and of non-corrosive lightweight thin overlays for bridges, have been carried out. Computer modeling programs for the estimation of pavement and bridge resurfacing life and costs, as well as pavement simulation machines, have also been developed.

By way of still further background, super insulator materials are known. These materials would improve the energy efficiency of thermal anti-icing methods. For example, silica aerogel has the known properties of extremely light weight, and excellent thermal insulating properties. Another known thermal insulator with excellent properties is the THERMAL DIODE coating developed by $27^{th}$ Century Technologies, Inc. This coating is described as creating an effectively one-way super-conducting path for thermal energy in one direction, but an excellent thermal insulator in the opposite direction. By way of still further background, one type of known tire stud material remains flexible and pliable under warm temperatures, but changes its molecular structure under freezing temperatures to become rigid.

By way of still further background, remote and on-site actuation of the dispensing of liquid chemical anti-icing agents onto the driving surfaces of bridges, tunnels, ramps, and roadways, is also known in the art.

BRIEF SUMMARY OF THE INVENTION

It is therefore an object of the present invention to provide a system for preventing the buildup of ice on a roadway or bridge deck by preventing the bonding of ice to the road surface.

It is a further object of this invention to provide such a system having a road cover that can be readily removed and replaced, for example with the change of season.

It is a further object of this invention to provide such a system that utilizes mechanical anti-icing, based on force applied by the vehicles themselves, to prevent ice buildup.

It is a further object of this invention to provide such a system that efficiently utilizes chemical anti-icing agents to minimize chemical runoff, and without requiring human intervention and labor.

It is a further object of this invention to provide such a system in which thermal anti-icing techniques are applied to the road surface in an extremely efficient manner.

It is yet a further object of this invention to provide such a system in which mechanical, thermal, and chemical anti-icing techniques are synergistically combined to maximize chemical and energy efficiency of the anti-icing process.

It is a further object of this invention to provide such a system that increases road surface traction on icy roads at freezing temperatures, but which provides a relatively smooth road surface at warmer temperatures.

Other objects and advantages of the present invention will be apparent to those of ordinary skill in the art having reference to the following specification together with its drawings.

The present invention may be implemented by way of a deformable road cover that is applied along the length of the roadway in strips that substantially match the width of vehicle tire paths. The road cover includes a layer having numerous parallel tubes that are adjacent to one another, and that are oriented transversely to the direction of travel. The tubes are deformable when driven across, with the exception of periodically selected ones of the tubes that are instead expanded or otherwise made incompressible; these non-deformable tubes provide increased friction for the tires of the overpassing vehicles. The road cover is preferably held in place on the roadway magnetically, and may be removed and replaced by way of rollers carried on a truck.

According to another aspect of the invention, thermal anti-icing can be combined into the road cover by including electric heating wire elements into selected ones of the parallel tubes; a highly thermally insulating layer is preferably disposed under the road cover, so that heat is directed only to the road cover surface and not to the underlying roadbed. The thermal efficiency provided by this road cover is therefore maximized.

According to another aspect of the invention, anti-icing chemicals are pumped through selected ones of the tubes, with these tubes having small orifices at their surface so that the chemicals are dispensed to the surface of the road cover. A reservoir of the chemical anti-icing chemical is maintained in an overhead reservoir, so that the chemicals are gravity fed to the road surface through a temperature-controlled valve. The deforming action of the parallel tubes under the weight of passing vehicles assists to dispense the anti-icing chemicals, and the tires of the passing vehicles distributes the dispensed chemicals.

According to another aspect of the invention, mechanical, thermal, and chemical anti-icing techniques are synergistically combined into a single road cover system. This combination provides excellent anti-icing performance while maximizing energy and chemical usage efficiencies, and minimizing run-off pollution.

BRIEF DESCRIPTION OF THE SEVERAL VIEWS OF THE DRAWING

FIGS. 5*a* through 5*e* are elevation and plan views illustrating the contacting relationship of a vehicle tire with the road cover according to the preferred embodiment of the invention.

DETAILED DESCRIPTION OF THE INVENTION

This invention will now be described in detail, with reference to a preferred embodiment of the invention. This embodiment will be described primarily in connection with the application of the invention to bridge decks and spans, by way of example, considering that these roadway portions are most susceptible to rapid and dangerous winter freezing. Those skilled in the art having reference to this specification will readily recognize that this invention is also applicable to many types of roadway surfaces, including street and highway surfaces, private driveways, and the like. This preferred embodiment of the invention will be described in connection with a combination of approaches to the anti-icing of roadways; it will be apparent, to those skilled in the art having reference to this description, that sub-combinations of this combination, using only one or two of the available mechanisms, may alternatively by employed within the scope of this invention. It is therefore to be understood that this description is presented by way of example only, and is not intended to limit the true scope of the invention as claimed.

As noted above in connection with the Background of the Invention, anti-icing and de-icing action is often necessary during winter months, especially in those regions that often have temperatures at or near the freezing point of water and are thus susceptible to ice formation. Anti-icing and de-icing is of course intended to take action at the locations of road surfaces at which vehicle tires make contact; as evident from watching any roadway, particularly in inclement conditions, the vehicles traveling within a particular roadway lane tend to follow the same tire tracks. According to this invention, significant efficiency in anti-icing and de-icing is attained by concentrating on these tire paths.

Figure 1B:
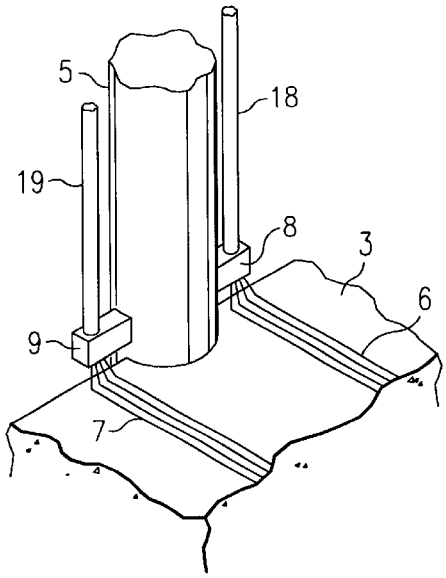
FIG. 1*b* is a perspective enlarged view of the location of the bridge deck of FIG. 1*a* at which a system control and supply module is attached to the road cover according to the preferred embodiment of the invention.
Figure 1A:
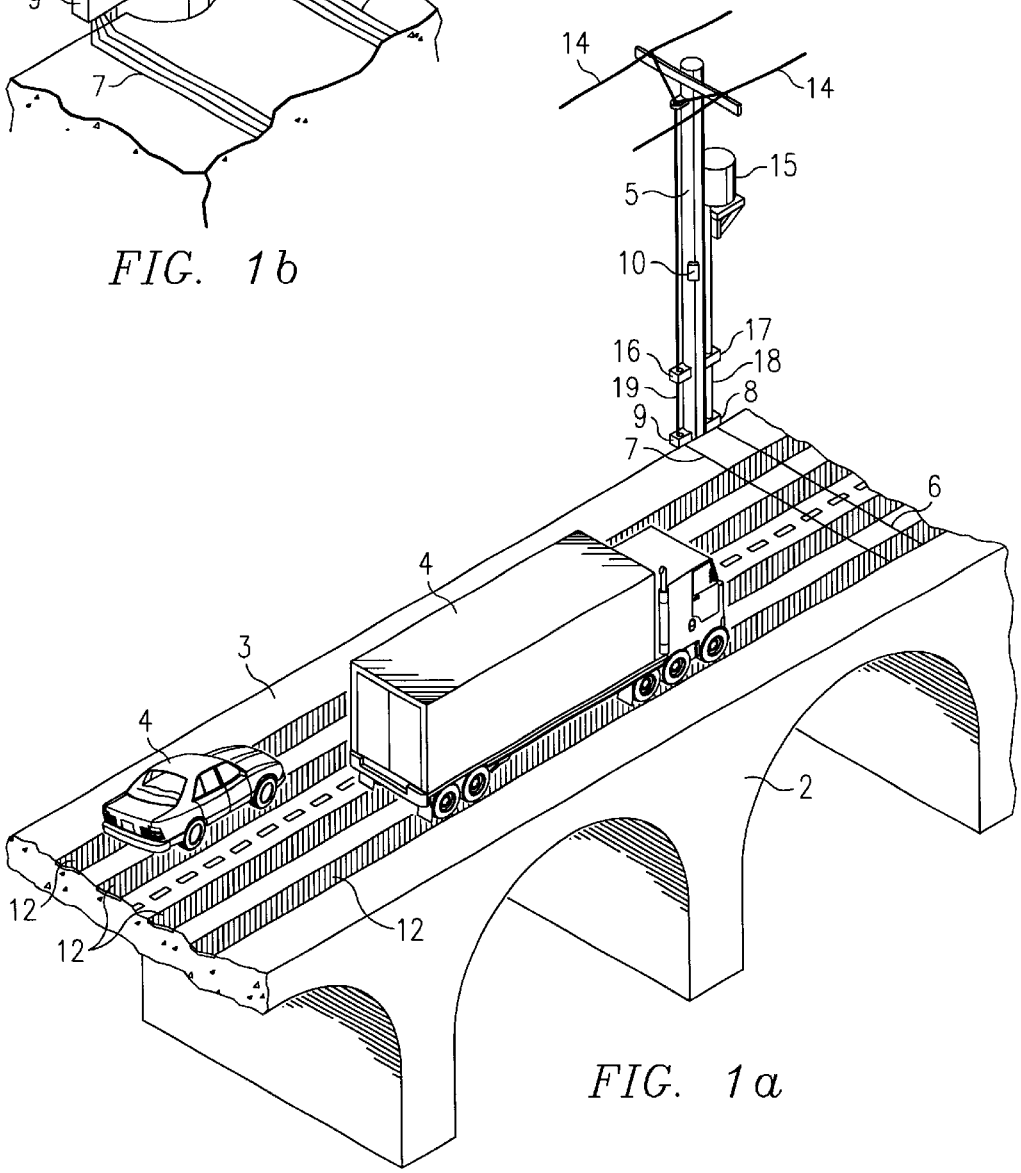
FIG. 1*a* is a perspective view of a bridge deck having an anti-icing road cover system according to the preferred embodiment of the invention.

Referring now to FIG. 1*a*, a road cover system constructed according to a preferred embodiment of the invention, and as applied to a bridge deck, will now be described in detail. In this example, bridge deck 2 is a two-lane, two-way portion of a bridge. Road covers 12 are shown as deployed in the form of parallel strips extending along the length of bridge deck 2, with two road covers 12 placed per lane to correspond to tire track locations followed by vehicles 4.

The road cover system of this preferred embodiment of the invention operates using a combination of mechanical, thermal, and chemical anti-icing mechanisms. Additionally, the road cover system of this preferred embodiment of the invention also provides improved traction, in addition to the anti-icing functions. While each of these mechanisms may be used individually, or in combination with one or the other mechanisms, and remain within the scope of this invention, it is contemplated that the combination of all three of the mechanical, thermal, and chemical approaches, in combination with the traction improvement function, provides synergy in that the energy required for the thermal mechanism and the chemical anti-icing agents can be minimized through the use of the combination of all three mechanisms.

In this regard, referring again to FIG. 1*a*, control and supply subsystems are shown as deployed on pole 5 adjacent to bridge deck 2. In this example, pole 5 is a power line pole, and as such carrier power lines 14 in the conventional manner. Thermal anti-icing is carried out by the application of electrical energy to road covers 12, as will be described in further detail below. In general, power switch control box 16, mounted to pole 5, receives electrical power from power lines 14 (preferably by way of a transformer, which is not shown), and is operable to forward electrical current to road covers 12 via cable 19 and distribution socket 9. As shown in more detail in FIG. 1*b*, distribution socket 9 is mounted at the base of pole 5, and supplies current to covers 12 by way of power conductors 7, each of which are plugged into socket 9. As will be described in further detail below, power conductors 7 run to and through road covers 12 to heat road covers 12 to a temperature above the freezing point of water (as may be chemically lowered, as described below). Preferably, power conductors are laid into grooves in the surface of bridge deck 2, so as to be hidden and protected from passing vehicles 4. The operation of power switch control box 16 is controlled by system control module 10, which contains or is coupled to sensors for detecting the ambient conditions at bridge span, such conditions including temperature, moisture on or precipitation at bridge deck 2, or even weather forecast conditions communicated to system control module 10 by wireless or other communications facilities.

Chemical anti-icing is carried out by a subsystem including storage container 15, also mounted to pole 5. Control valve 17 is also mounted to pole 5, and controls the flow of liquid anti-icing chemicals from storage container through distribution box 8. As shown in additional detail in FIG. 1*b*, distribution box 8 is mounted near the base of pole 5, and connects to chemical supply tubes 6 which in turn run to road covers 12. As will be described below, road covers 12 dispense the anti-icing chemicals to their surface, lowering the freezing temperature of the water solution in the roadway. Preferably, tubes 6 are inlaid into the surface of bridge deck 2 so as to be hidden and protected from passing vehicles 4 and environmental conditions. Control valve 17 is also controlled by system control module 10, in response to sensed or communicated weather conditions.

Figure 2A:
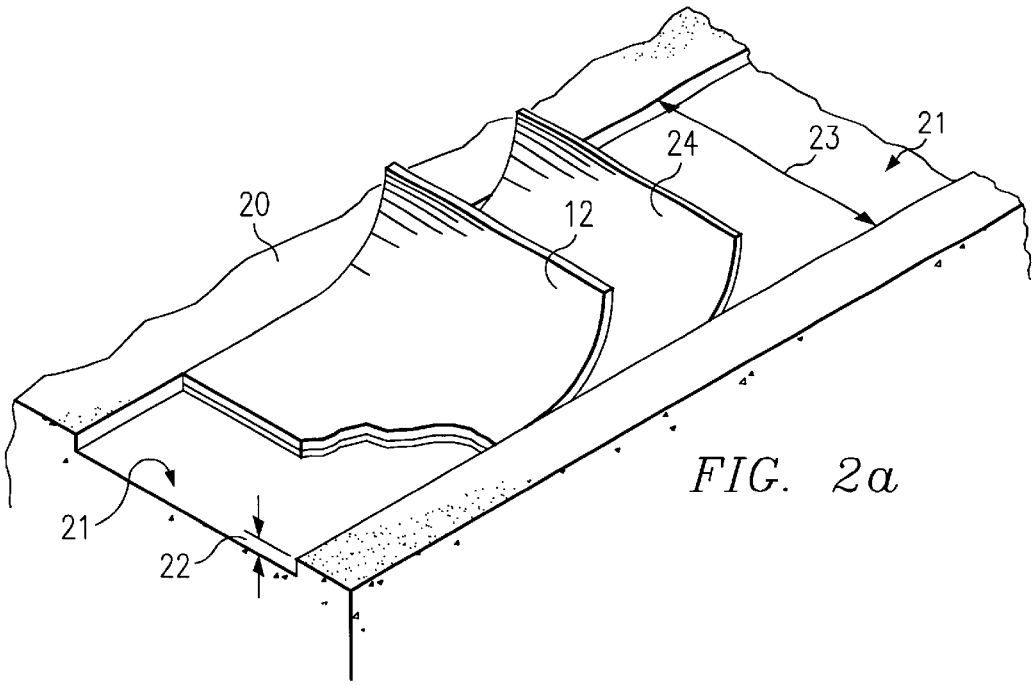
FIGS. 2*a* and 2*b* are perspective exploded views of a portion of a road cover according to the preferred embodiment of the invention.
Figure 2B:
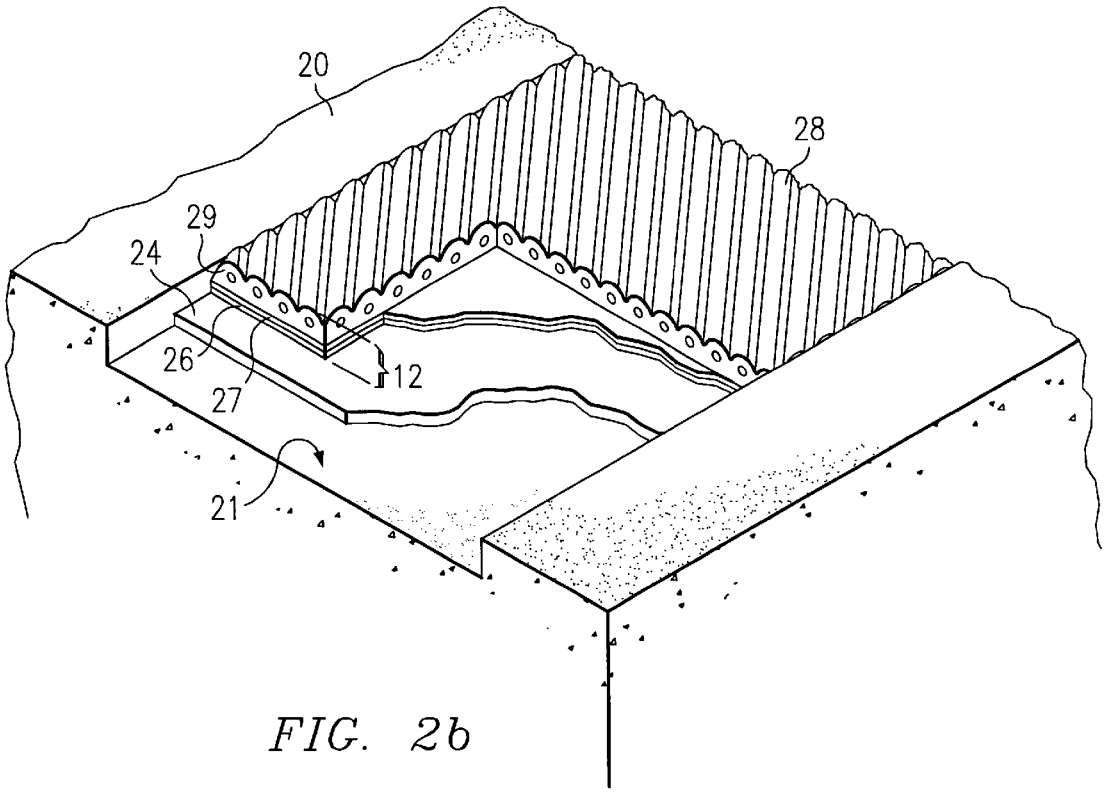

Referring now to FIGS. 2*a* and 2*b*, the construction of laminated multi-layer road covers 12 and their operation as mechanical de-icing elements will now be described in detail. FIG. 2*a* shows road surface 20 of bridge deck 2, in which groove 21 is cut to a depth 22 of on the order of one-eighth to one-fourth of an inch. This relatively thin depth is contemplated to have no impact on the structural strength of bridge deck 2. To accommodate the tire tracks of passing vehicles 4, it is contemplated that width 23 of groove 21 is on the order of three to four feet. Groove 21 may be formed in the original construction of bridge deck 2, or after bridge deck 2 has been constructed and used, in which case conventional cutting of the concrete or asphalt or road surface 20 may be done. In addition to providing countersinking of road cover 12, groove 21 removes oil and dirt from road surface 20, providing good adhesion for the underpinning of road cover 12 as will become apparent from this description.

As shown in FIG. 2*a*, base magnetic cover 24 is affixed to groove 21 of road surface 20. According to this embodiment of the invention, base magnetic cover 24 can be in the form of a ceramic coated steel plate, or a non-porous flexible magnetic layer. In either case, base magnetic cover 24 is contemplated to remain in place on road surface 20 for an extremely long period of time (i.e., many years), and therefore is preferably permanently bonded to the surface of groove 21 of road surface 20, for example by way of an epoxy or other adhesive. It is contemplated that the thickness of base magnetic cover 24 is on the order of one thirty-second to one-sixteenth of an inch.

Road cover 12 is then installed over base magnetic cover 24. According to this preferred embodiment of the invention, as shown more particularly in FIG. 2*b*, road cover 12 is a multiple-layer element, which in this embodiment of the invention consists of a lamination of bottom magnetic layer 26, intermediate thermal insulation layer 27, and top tube layer 28. Bottom magnetic layer 26 of road cover 12 is a non-porous rubberized flexible magnetic layer that adheres to base magnetic cover 24 by magnetic force only (i.e., without an interposed adhesive). If the magnetic element of base magnetic cover 24 is a steel plate, no particular orientation is required; conversely, if magnetic cover is also a flexible magnetic layer, similar to magnetic layer 26, the corresponding magnetic polarity of the two elements should be aligned to attract one another. It is contemplated that the magnetic adhesion force between magnetic layer 26 and base magnetic cover 24 will hold the elements together strongly in the case of applied shear stresses, such as will occur from turning and stopping of passing vehicles 4, but will still permit easy separation as magnetic layer 26 is pulled upwardly away from base magnetic cover 24, as will be described below. This magnetic adhesion permits easy deployment and removal of road cover 12, for example in connection with the change of season or for periodic maintenance and replacement.

If necessary or desired, adhesion between road cover 12 and base magnetic cover 24 can be enhanced by the combination of an adhesive with the magnetic force. For example, a thin adhesive film may be sprayed onto the surface of base magnetic cover 24 prior to deployment of road cover 12. If an adhesive is used, it is preferably non-hardening, so that road cover 12 can be removed later.

A next laminated layer of road cover 12, overlying bottom magnetic layer 26, is thermal insulator layer 27. According to this embodiment of the invention, thermal insulator layer 27 is preferably a thin layer of a so-called super insulator material, to effectively prevent conduction of heat downward into bridge deck 2. Examples of such a thermal insulator material include silica aerogel, and the THERMAL DIODE coating developed by $27^{th}$ Century Technologies, Inc.

Top tube layer 28 of road cover 12 includes a series of closely-packed parallel tubes 29. Tubes 29 are preferably constructed of a high-strength, wear-resistant, yet deformable, material, such as conventional automobile tire rubber, neoprene, and other similar substances. It is contemplated that the diameter of each of tubes 29 is preferably on the order of three-eighths to one-half inch; the inner diameter of each of tubes 29 is contemplated to be on the order of one-third to one-half of its diameter. As shown in FIG. 2*b*, the orientation of tubes 29 is preferably oblique to the direction of travel along road surface 20. Preferably, tubes 29 are molded together into integral tube layer 28, which has a unitary flat bottom that is permanently affixed to thermal insulator 27 by way of an epoxy or other high strength adhesive.

Tube layer 28, in addition to being high-strength and wear-resistant, is preferably harder than conventional tire rubber, while having an upper surface that provides some improved traction to passing vehicles in dry conditions. It is preferred, however, that the friction and traction between road cover 12 and passing traffic not be excessive, to avoid the possibility of loss of control in sudden stops and the like. In addition, it may be preferable to provide an external length of a friction transition zone material on either end of road covers 12, to avoid danger caused by too large of a contrast in road surface encountered by vehicles passing from the normal road surface to road covers 12.

Figure 3A:
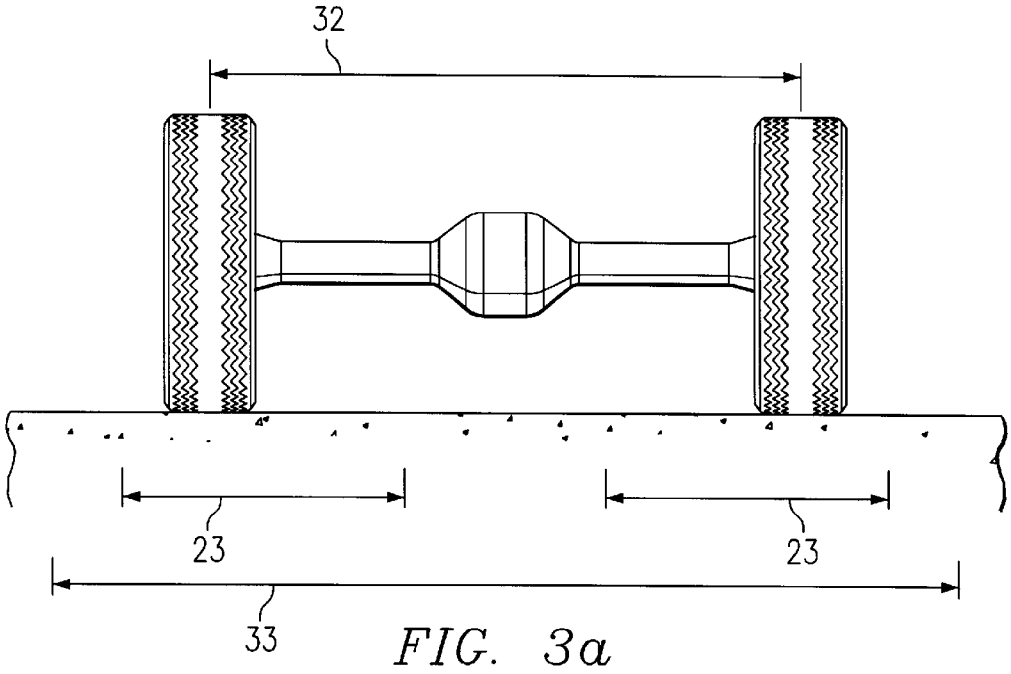
FIGS. 3*a* through 3*d* are cross-sectional views illustrating the installation of a road cover according to the preferred embodiment of the invention.

FIGS. 3*a* through 3*d* illustrate the steps of installation of road covers 12 according to this preferred embodiment of the invention. FIG. 3*a* illustrates wheelbase 32 between tires of a passing vehicle within typical road lane width 33.

Widths 23 can therefore be readily selected to provide paths for vehicle tires to travel within lane width 33. It is contemplated that, given a typical road lane width 33 of twelve feet, and a range of typical wheelbase 32, and providing some tolerances for drivers, widths 23 of on the order of three to four feet will be acceptable for the deployment of road covers 12.

Figure 3B:
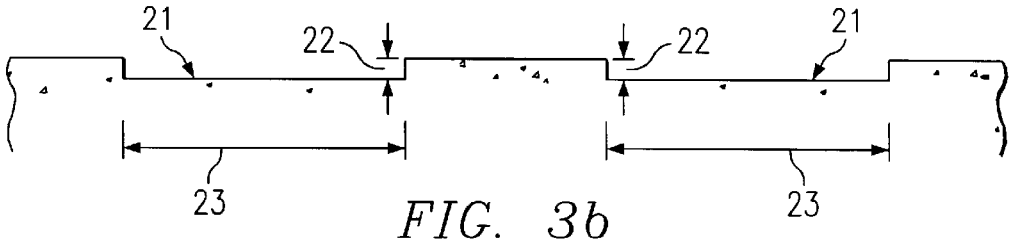
Figure 3C:
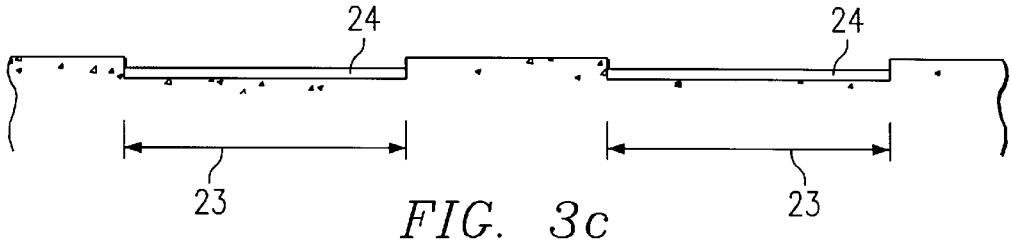
Figure 3D:
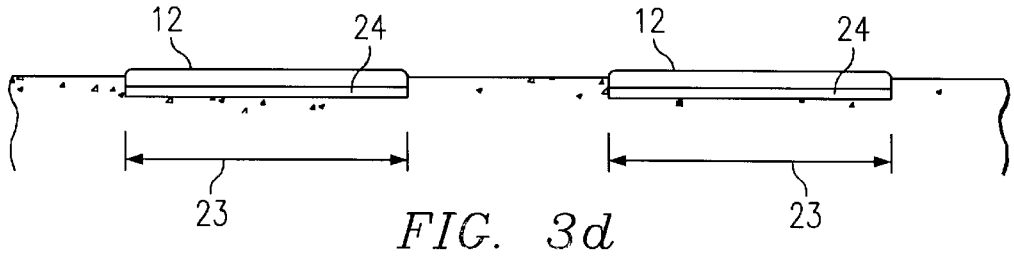

The cutting of grooves 12, each of width 23, to the desired depth 22 of on the order of one-eighth to one-fourth of an inch, is illustrated in FIG. 3*b*. This is followed, as shown in FIG. 3*c*, with the adhesion of base magnetic cover 24 within each of grooves 21, by way of an epoxy or other strong permanent adhesive. The surface of base magnetic cover 24 is contemplated to remain below road surface 20, as shown in FIG. 3*c*. Road covers 12 are then installed over base magnetic cover 24, in a manner described in further detail below, to sit within grooves 21 but extend slightly above road surface 20, as shown in FIG. 3*d*.

An example of the deployment of road cover 12 according to the preferred embodiment of the invention will now be described relative to FIGS. 4*a* through 4*c*. As noted above relative to FIG. 3*b*, base magnetic cover 24 is first permanently installed within grooves 21. If base magnetic cover 24 is constructed as a ceramic-covered steel plate, for example, base magnetic cover 24 would simply be laid into grooves 21 by hand, with the appropriate epoxy or other adhesive dispensed under base magnetic cover 24.

Figure 4A:
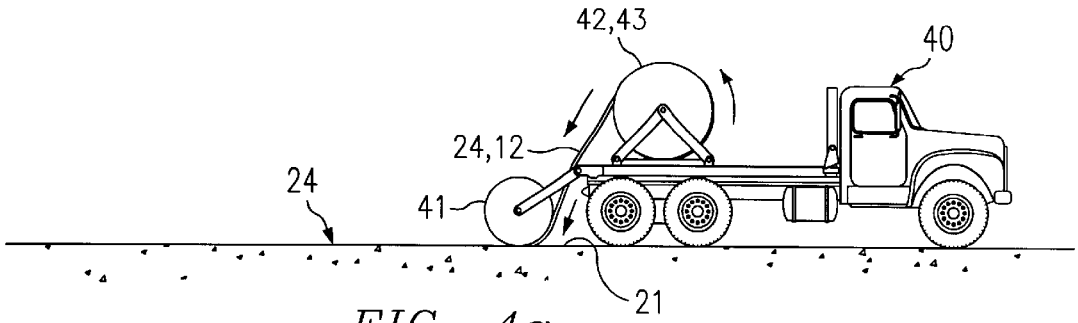
FIGS. 4*a* through 4*c* are elevation views illustrating the installation and removing of a road cover according to the preferred embodiment of the invention.

If, on the other hand, base magnetic cover 24 is constructed as a non-porous flexible magnetic layer, base magnetic cover 24 may be quickly installed in the manner shown in FIG. 4*a*. It is contemplated that flexible magnetic material, such as that used in the construction of flexible refrigerator magnets, can be fabricated in long rolls, up to on the order of hundreds of feet in length. As such, installation truck 40 of FIG. 4*a* carries reel 42 of this magnetic material, followed by a trailing pressure reel 41. Installation of base magnetic cover 24 then is carried out by truck 40 traveling slowly along road surface 20, with base magnetic cover 24 being laid into grooves 21, and pressed into place by pressure roller 41. Adhesive material (not shown) is dispensed into grooves 21 in advance of pressure roller 41, either by human workers laying the adhesive into grooves 21 behind the wheels of truck 40, or dispensed automatically from truck 40. Pressure roller 41 ensures that base magnetic cover 24 is flattened and firmly bonded to grooves 21.

Following the installation of base magnetic cover 24 (either by the laying of plates or in the manner shown in FIG. 4*a*), and any necessary curing of adhesive, road cover 12 is next installed by way of truck 40. In this case, reel 43 has hundreds of feet of magnetic cover 12 rolled thereon. Road cover 12 is then fed from truck 40, under pressure roller 41, so as to be deployed into grooves 21 on top of base magnetic cover 24. As discussed above, an adhesive may be used in the attachment of road cover 12 onto base magnetic cover 24, if desired, although it is contemplated that the magnetic force alone may be sufficient in many applications. Road cover 12 is thus easily installed as truck 40 travels along road surface 20.

Figure 4B:
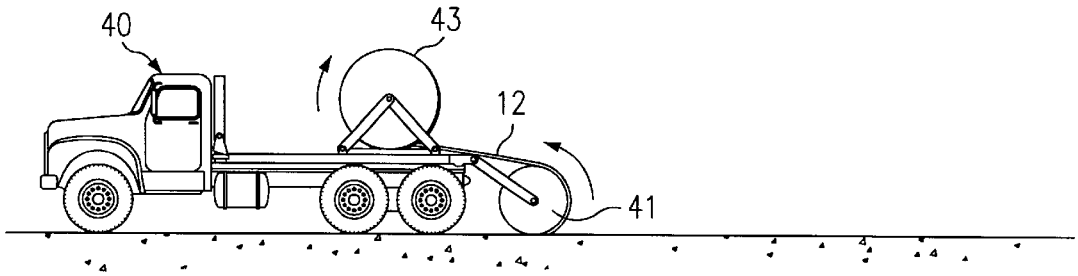

Removal of road cover 12 is easily performed, also by truck 40 as shown in FIG. 4*b*. In this case, pressure roller 41 operates as a take-up roller, with road cover 12 threaded over the top of pressure roller 41 to reel 43. In this case, truck 40 begins at one end of road cover 12 to be removed, and begins traveling along road cover 12; preferably, reel 43 is powered to wind up road cover 12. Road cover 12 then winds onto reel 43 as truck 40 travels along road surface, with the magnetic force between road cover 12 and base magnetic cover 24 overcome by the operation of truck 40 and reel 43.

Figure 4C:
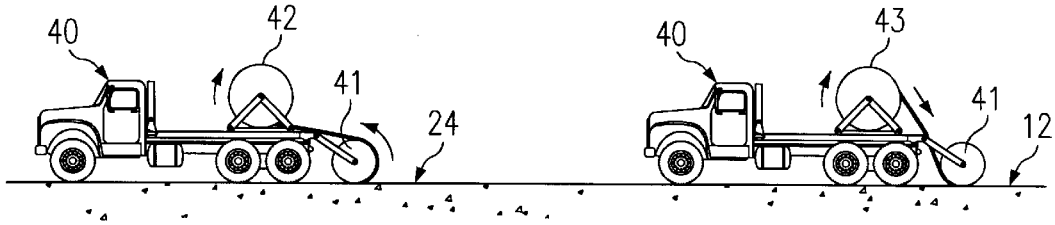

FIG. 4*c* illustrates a seasonal change operation, in which one road cover is removed and another deployed. For example, it is contemplated that a summer road cover that simply provides good traction, and anti-skidding performance when wet, can be used during summer, with road cover 12 including the de-icing mechanisms described in this specification being used during winter months. Alternatively, road cover 12 may simply be periodically replaced for maintenance purposes. In either case, one truck 40 may be operating in a take-up fashion to remove a road cover 12 and expose base magnetic cover 24. Another truck 40 travels closely behind, installing road cover 12 over base magnetic cover 24 as shown in FIG. 4*c*.

Referring next to FIGS. 5*a* through 5*e*, the concept of traction improvement for vehicles over road surfaces will now be discussed, in a general sense. FIGS. 5*a* through 5*c* illustrate tire 51 of a vehicle in contact with a roadway. The actual area of contact 55 has width 53 (FIG. 5*b*) and length 52 (FIG. 5*a*). As evident from FIG. 5*c*, area 55 is somewhat smaller than the projection 56 of the cross-sectional area of tire 51 onto the roadway. In any event, traction of tire 51 against the roadway depends upon the coefficient of friction within contact area 55, in combination with the portion of the gravitational mass of the vehicle supported by tire 51 and its contact area 55. As is fundamental to modern automobile drivers, if the roadway has a slippery (i.e., icy) surface, friction and thus traction can be improved by scattering small sharp features, such as grains of sand, over the surface.

FIGS. 5*d* and 5*e* illustrate the contacting of tire 51 with road cover 12, as applied to a roadway according to the preferred embodiment of the invention. Road cover 12, as noted above and as will be described in further detail below, provides ridges 57 for the improvement of traction for passing vehicles in icy conditions. Ridges 57 are oblique to the direction of travel, as shown in FIG. 5*d*, and are spaced apart by distance 58. Spacing distance 58 is determined by consideration of length 52 of a typical tire contact area, considering the worst case of the smallest radius vehicle tire expected to travel along road cover 12. In this example, spacing distance 58 is selected to provide at least two ridges within a typical contact area 55 of tire 51 with road cover 12. These ridges 57 are contemplated to provide similar gripping elements for tire 51 against road cover as would grains of sand, or tire chains. In this manner, even if a thin sheet of ice is present over the surface of road cover 12, ridges 57 provide improved traction for vehicle tires.

Figure 6A:
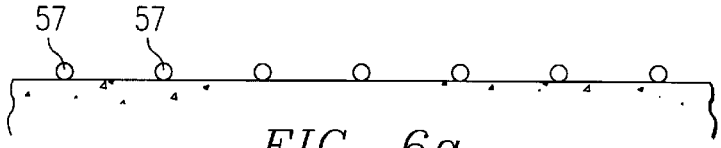
FIGS. 6*a* through 6*e* are elevation and perspective views illustrating the operation of the road cover according to the preferred embodiment of the invention.

FIGS. 6*a* through 6*e* illustrate the operation of road cover 12 according to the preferred embodiment of the invention. FIG. 6*a* illustrates, similarly as FIG. 5*e* described above, the location of ridges 57 along the surface of a roadway, as desired for the improvement of vehicle traction during icy conditions.

Figure 6B:
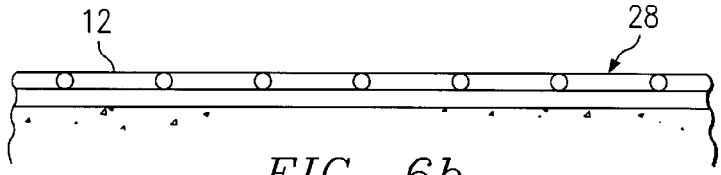
Figure 6C:
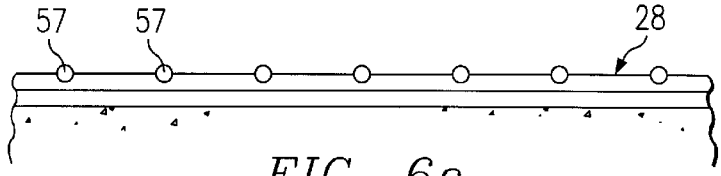

According to the preferred embodiment of the invention, ridges 57 extend from road cover 12 when ambient conditions are conducive to ice formation, but are flush with road cover 12 to provide a smooth driving surface in warm conditions. This operation is illustrated in FIGS. 6*b* and 6*c*. FIG. 6*b* illustrates the state of road cover 12 according to this embodiment of the invention in warm conditions. As evident from FIG. 6*b*, ridges 57 are contained within surface 28 of road cover 12 in these conditions, so that road cover 12 is providing a smooth surface to passing vehicles. FIG. 6*c* illustrates the state of road cover 12 when the ambient conditions are conducive to ice formation; these conditions include temperatures of at or about freezing, in combination with sufficient moisture from precipitation or condensation. In this state, ridges 57 extend above surface 28 of road cover 12, thus providing improved traction to passing vehicles.

Figure 6D:
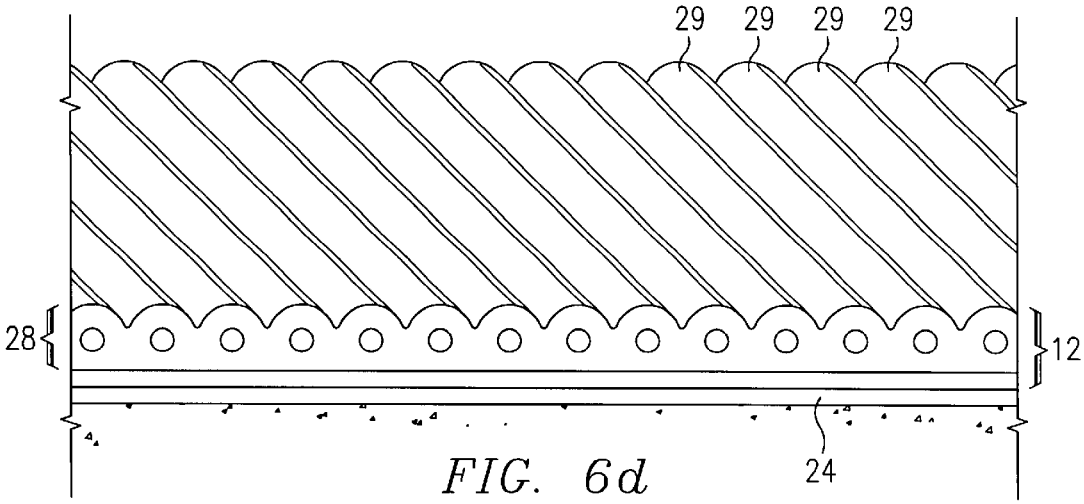
Figure 6E:
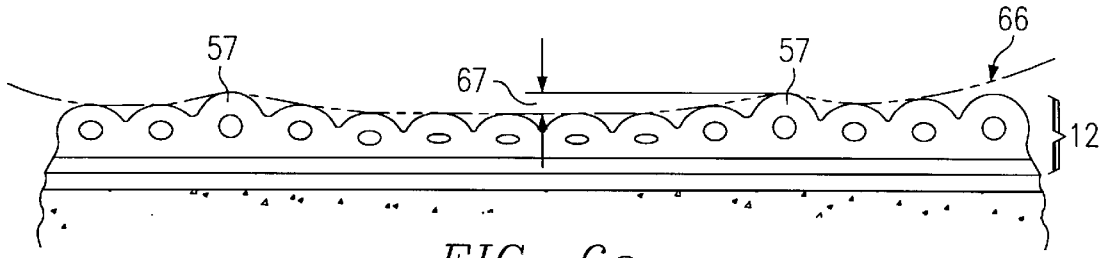

The general operation of road cover 12 is shown in FIGS. 6*d* and 6*e*. In this general sense, road cover 12 includes tube layer 28 containing parallel tubes 29 as described above. In FIG. 6*d*, again illustrating the warm weather condition, all of tubes 29 have approximately the same outside diameter, thus providing a substantially flat surface to the roadway. FIG. 6*e* illustrates the general state of road cover 12 in freezing conditions. Ridges 57 are defined by certain ones of tubes 29 that retain their full outside diameter while others of tubes 29 collapse to a reduced thickness 67. In this state, ridges 57 extend above the surface of the collapsed ones of tubes 29 with reduced thickness 67, providing the improved traction to tire 68 of a passing vehicle.

It is contemplated that the extent to which ridges 57 extend above the collapsed surface 69 should somewhat approach the dimensions of sand grains and other substances known to improve traction on icy surfaces. In this regard, increasing the differential thickness between ridges 57 and surface 69 is favorable, as it is believed that the coefficient of friction is substantially proportional to this differential thickness.

In addition, it is contemplated that each of tubes 29, whether or not serving as ridges 57, remain deformable in ice-conductive conditions, to provide a mechanical anti-icing function for road cover 12. It has been observed that the shear and tensile strength of ice is much weaker than its compressional strength. For example, a thin layer of ice that forms over a road surface (e.g., so-called "black ice") is tightly bonded to the road surface, and remains unbroken when vehicles pass over it. However, such a sheet of ice is easily broken by vehicles at those locations having underlying air or water bubbles, which deform in the presence of a downward force. According to the preferred embodiment of the invention, tubes 29 of road cover 12 all remain deformable under the force applied by the tire of a passing vehicle. This deformation, provided by the construction of the tube layer containing tubes 29, deflects the surface of contact to such an extent that a thin layer of ice will tend to be broken as the vehicle passes over road cover 12. Assuming sufficient traffic passing over road cover 12, any ice forming over road cover 12 in freezing conditions will be broken up, and not permitted to form a dangerous contiguous sheet. This mechanical de-icing mechanism provided by road cover is believed to be quite effective in maintaining a safe roadway.

Various approaches to providing differential behavior of tubes 29 in road cover 12 in freezing conditions are contemplated, according to this invention. According to one implementation, tubes 29 (other than those forming ridges 57) are filled with a solid, liquid, or gas that provides a fixed volume during warm conditions, but that collapse in freezing conditions, either because of a change in properties of the material in with temperature, or through the action of an external control. Those tubes 29 that form ridges 57 may be filled with a different material, or may be differentially controlled to remain filled when conditions became conducive to the formation of ice, so as to extend above the surface o the collapsing ones of tubes 29.

Figure 7A:
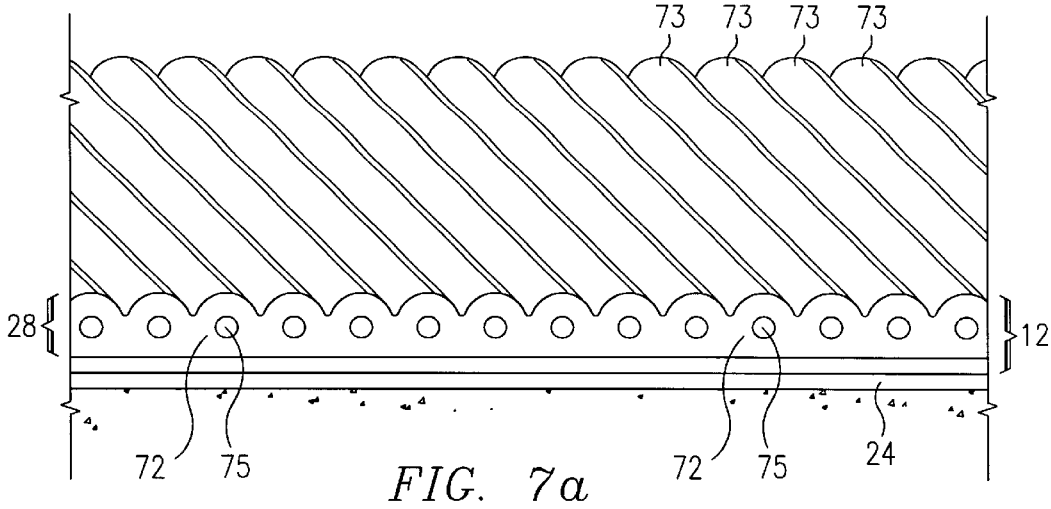
FIGS. 7*a* through 7*c* are perspective, cross-sectional, and plan views illustrating the operation of the road cover in freezing temperatures, according to the preferred embodiment of the invention.
Figure 7B:
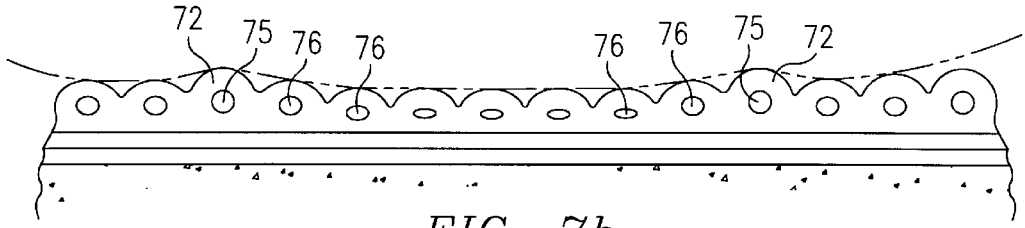
Figure 7C:
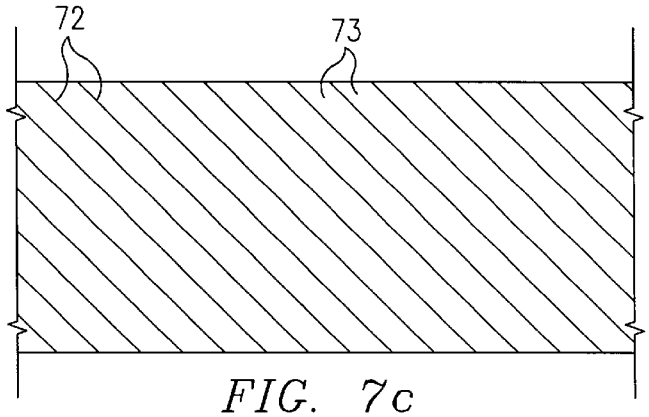

Referring now to FIGS. 7*a* through 7*c*, the construction of road cover 12 to provide such differential behavior, according to the preferred embodiment of the invention, will now be described in detail.

As shown in FIG. 7*a*, road cover 12 includes tubes 72, 73. Tubes 73 comprise most of road cover 12, and correspond to the collapsible tubes described above relative to FIG. 6*e*; tubes 72, on the other hand, correspond to ridges 57 and as such will extend above the surface of tubes 73. According to one implementation, tubes 72 are filled with water 75, and then sealed. Tubes 73, on the other hand, are filled with a substance that is in a gas phase at temperatures at or above about the freezing point of water, but which transitions to a liquid phase at temperatures at or below about the freezing point of water. Examples of such a substance are the FREON refrigerants, including mixtures of these refrigerants. In this implementation, tubes 73 will extend to their full height at warm temperatures, presenting a smooth driving surface with tubes 72. On the other hand, as shown in FIG. 7*b*, interiors 76 of tubes 73 will become collapsible, if not collapse, as the temperature drops below freezing, while tubes 72 will remain filled with water. Indeed, if water 75 inside of tubes 72 freezes, tubes 72 will slightly expand along with the expansion of water 75 into its solid phase. In this state, shown in FIGS 7*b* and 7*c*, hardened tubes 72 extend above the surface of collapsed tubes 73, providing an equivalent effect as steel road chains mounted on vehicle tires, and thus providing improved traction to passing vehicles. In addition, since all of tubes 73 of road cover 12 remain deformable under the weight of passing vehicles, mechanical anti-icing effects will also occur, preventing the formation of a dangerous contiguous sheet of ice.

According to another implementation of this embodiment of the invention, interiors 76 of tubes 72 can be filled with a thermo-reactive rubber, which remains flexible at temperatures at or above freezing, but which changes its molecular structure to become rigid and actually expand at temperatures at or below freezing. Such thermo-reactive rubber has been used in connection with tire studs in Japan.

It is contemplated that the mechanical de-icing provided by road cover 12 as shown in FIGS. 6*a* through 6*e* and FIGS. 7*a* through 7*c* can provide an extremely reliable and pollution-free road cover for roadway surfaces, especially bridge decks, which are conducive to rapidly icing over. In addition to the mechanical de-icing property, the provision of periodic ridges in road cover 12 in freezing conditions also improves the traction of the road cover, in a manner that occurs automatically as the temperature drops to below freezing. Little or no human intervention is thus required in order to provide a safe road surface.

In addition to the mechanical de-icing and traction improvement, road cover 12 may also have the capability to thermally de-ice the road surface, as will now be described in connection with FIGS. 8*a* through 8*d*.

Figure 8A:
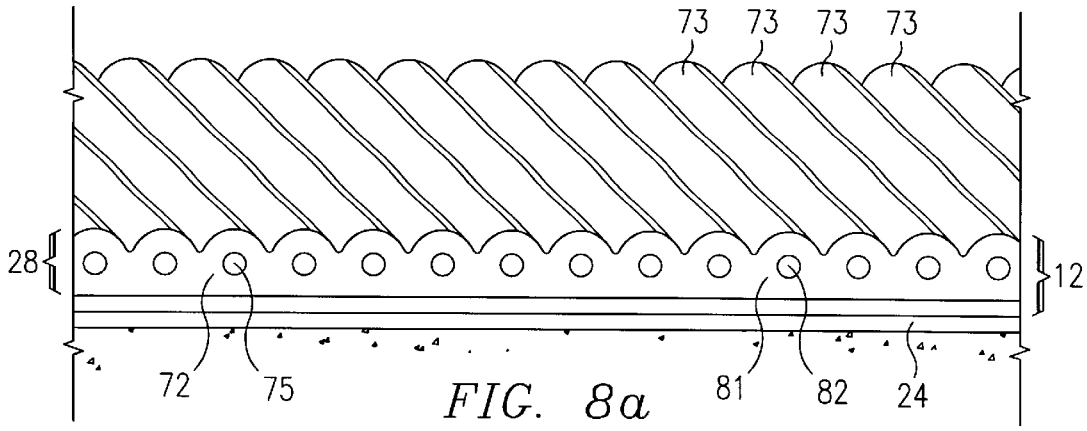
FIGS. 8*a* through 8*d* are perspective, plan, and cross-sectional views of a road cover, including heating elements, according to the preferred embodiment of the invention.
Figure 8B:
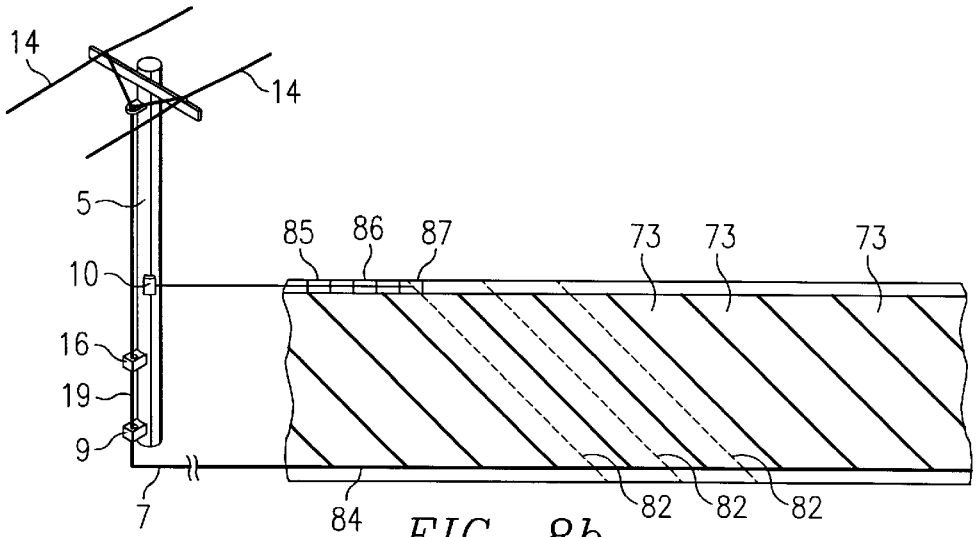
Figure 8C:
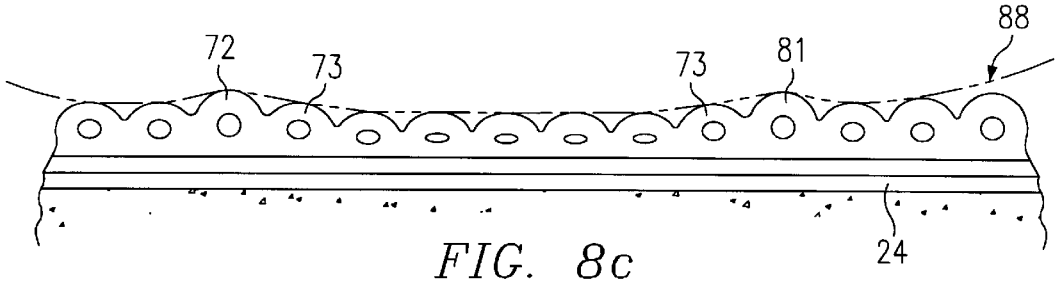

As shown in FIGS. 8*a* and 8*b*, tubes 81 are periodically provided in road cover 12, with electrical heating coil 82 within its interior. In this example, tube 81, as shown in FIG. 8*b*, replaces alternating ones of tubes 72 (FIG. 7*a*), as it is contemplated that tube 81 will also retain its height in freezing conditions, with tubes 73 again collapsing to provided a differential height between tubes 72, 81 and tubes 73 in this condition, as shown in FIG. 8*c*.

Figure 8D:
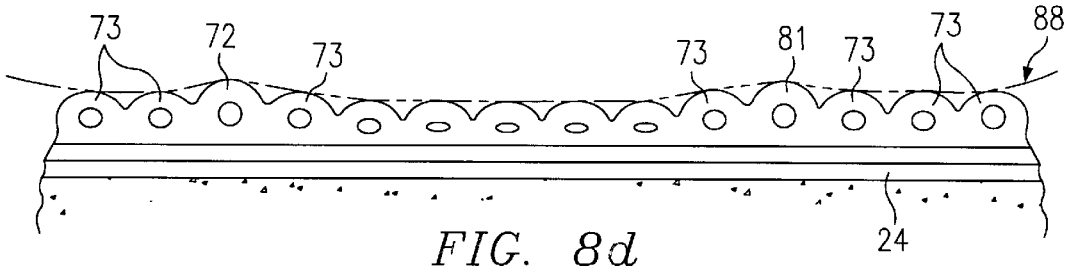

As shown schematically in FIG. 8*b*, heating coils 82 are powered in parallel, by power cord 84, which extends along the length of, and is embedded in, road cover 12. Power cord 84 is coupled by external power cord 7 to distribution socket 9 Distribution socket 9 is connected, by way of cable 19, to power switch control box 16, which in turn is controlled by system control module 10 as will be described below. In this manner, heating coils 82 are activated upon detection of conditions conducive to the formation of ice, so that heat is applied to road cover 12 to prevent the formation of any ice on the surface of road cover 12. The deformation of tubes 72, 73, 81, and the resulting mechanical anti-icing mechanism, will assist the thermal anti-icing mechanism effected by heating coils 82, in preventing the formation of dangerous icy conditions at the road surface. It is contemplated however, that some tubes 73 that are near heated tubes 81 may be heated to above the freezing point, and again expanding back to their full height as shown in FIG. 8*d*.

As discussed above, tubes 72, 73, 81 are disposed on a thermal insulator layer 27. Thermal insulator layer 27 is preferably an excellent thermal insulator, so that the thermal energy produced by heating coils 82 is not absorbed by the bridge deck, but is instead directed only to the surface of road cover 12. This insulation greatly improves the energy efficiency of road cover 12 according to the preferred embodiment of the invention, especially relative to conventional thermal anti-icing installations.

As shown in FIG. 8*b*, according to this preferred embodiment of the invention, the thermal anti-icing mechanism may be implemented in an intelligent and automated manner. Temperature sensor 85, precipitation sensor 86, and icing sensor 87, are shown as deployed along road cover 12. It is contemplated that those skilled in the art will be readily able to provide such sensors. Temperature sensor 85 can be implemented as a thermocouple or other conventional temperature sensor that can be electrically interrogated. Precipitation and icing sensors 86, 87 may be implemented in the conventional manner, for example by way of a resistance bridge or the like that measures a local resistance at the surface of road cover 12 or of bridge deck 2. In any event, sensors 85, 86, 87 are in communication with system control module 10 as shown in FIG. 8*b*.

According to this preferred embodiment of the invention, system control module 10 is a programmable computer capable of polling sensors 85, 86, 87 and of making control decisions based on the measurements communicated thereto. In addition, it is contemplated that system control module 10 also includes wireless communications capability, for receiving control commands from a remote central control location, as well as for communicating system status to that remote central control location. System control module 10 is contemplated to be powered from power lines 14 carried by pole 5, or by way or solar panels (not shown), in each case with battery backup.

The particular decision algorithm implemented in system control module 10 can be as simple or as complicated as desired. According to the preferred embodiment of the invention, it is contemplated that system control module 10 will periodically poll sensors 85, 86, 87. The frequency of such polling can depend upon the particular conditions; for example, if temperatures well above the freezing point are sensed by sensor 85, or communicated from central control, , the polling of sensors 85, 86, 87 can be set to be quite infrequent, or not performed at all. Upon determining, in response to a polling event, that conditions at road cover 12 are conductive to the formation of ice, system control module 10 then effects thermal de-icing action. An example of this determining can include the sensing of a temperature at or below about the freezing point, in combination with precipitation sensor 86 detecting the presence of moisture at road cover 12. Alternatively, the determination can also be made in response to icing sensor 87 itself detecting the formation of ice at road cover 12 or the roadway itself, regardless of the temperature and detected precipitation. In any case, upon determining that an icing condition is present, system control module 10 issues a command to power switch control box 16, responsive to which power switch control box 16 applies electrical power to heating coils 82. Tubes 81 of road cover 12 are then heated, thermally de-icing the driving surface. Upon sensors 85, 86, 87 then detecting that the icing conditions are no longer present at road cover 12, system control module 10 will issue a command to power switch control box 16 to switch off the application of electrical power to heating coils 82.

According to this embodiment of the invention, in which thermal anti-icing is used in combination with mechanical anti-icing, it is contemplated that the energy efficiency of the system is maximized in several ways. First, as noted above, the thermal insulating layer 27 ensures that all heat is directed toward the surface of road cover 12, and thus toward the ice to be melted, maximizing the use of this electrical energy. Secondly, it is contemplated that the intelligent control of the thermal anti-icing mechanism ensures that electrical energy usage is minimized, and not used when icing conditions do not prevail. Further, the entirety of the bridge deck or road surface is not heated; rather, only the tire tracks at which road covers 12 are deployed are heated. It is contemplated that the combination of these efficiencies permit this embodiment of the invention to maintain a safe driving surface while using as little as one-sixteenth of the energy used by conventional thermal anti-icing systems. This embodiment of the invention is also automated, so as not to require human control and intervention, and is also substantially pollution-free.

Figure 9A:
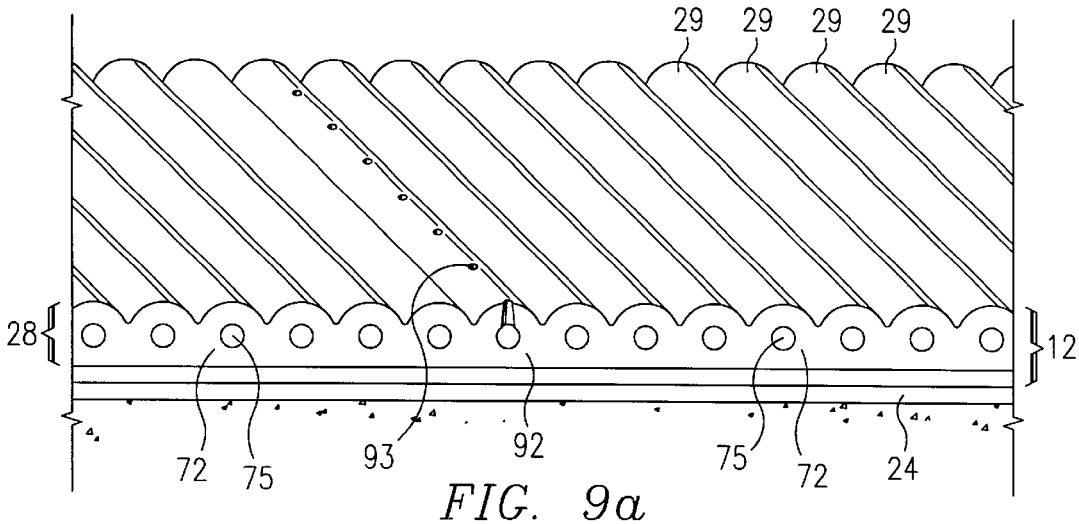
FIG. 9*a* is a perspective view of a road cover, including anti-icing chemical dispensing capability, according to the preferred embodiment of the invention.
Figure 9B:
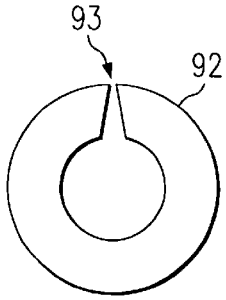
FIG. 9*b* is a cross-sectional view of one tube in the road cover of FIG. 9*a*, according to the preferred embodiment of the invention.

Referring now to FIGS. 9*a* through 9*d*, the implementation of chemical anti-icing mechanisms into road cover 12 will now be described in detail. The construction of road cover 12 of hollow tubes, as described above, facilitates the dispensing of anti-icing chemical fluids using those tubes. As shown in FIG. 9*a*, according to this embodiment of the invention, selected tubes 92 have orifices 93 at their top surface, and are dedicated for use as anti-icing chemical dispensing tubes. Orifices 93 are preferably of a conical cross-section, as shown in FIG. 9*b*, to prevent clogging by dirt or other foreign material as is generally encountered at road surfaces. This shape also increases the pressure of fluid as it exits tube 92, dislodging any dirt or other contaminant that is clogging the surface of orifices 93. It is contemplated that this shape of orifices 93 can be readily performed by conventional drilling tools, for example by rotating the position of the drill bit after a cylindrical hole has been drilled through the wall of tube 92.

Figure 9C:
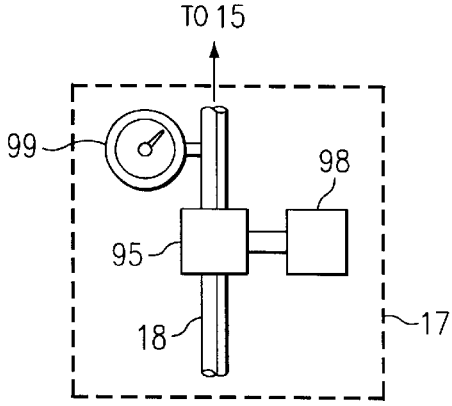
FIG. 9*c* is a schematic diagram illustrating a control system for dispensing of anti-icing chemicals according to the preferred embodiment of the invention.
Figure 9D:
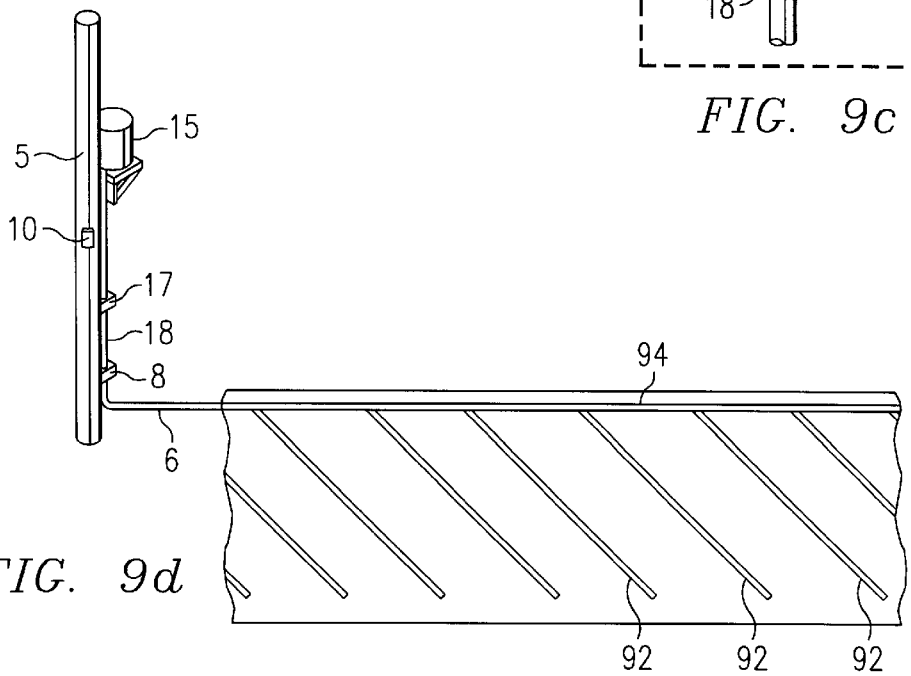
FIG. 9*d* is a cross-sectional and elevation view of the position of the control system of FIG. 9*c* in combination with the road cover, according to the preferred embodiment of the invention.

FIG. 9*d* illustrates the connection of tubes 92 of road cover 12 with a controllable supply of the anti-icing chemicals, according to the preferred embodiment of the invention. In this embodiment of the invention, supply line 94 is embedded along an edge of road cover 12, and is connected to one end of each of tubes 92, to supply tubes 92 with anti-icing chemical fluid in parallel. As suggested by a comparison of FIG. 9*d* with FIG. 8*b*, supply line 94 is on the opposite side of road cover 12 from power line 84 which distributes current to heating coils 82 (not shown). Fluid supply line 94 is connected, by way of external chemical supply tube 6, which in turn plugs into branching box 8. Branching box 8 is preferably provided with multiple outlets, so that the same supply system can support multiple road covers 12. Branching box 8 is supplied through tube 18 by control valve 17, which controls whether anti-icing chemical fluid from supply tank 15 is to pass to tubes 92. Control valve 17 is controlled by system control module 10, preferably in response to sensed or communicated conditions as described above.

FIG. 9*c* illustrates the construction of control valve 17 in additional detail. Supply tank 15 is coupled to control valve 17 from above, permitting the flow of chemicals to be driven by the force of gravity. Pressure sensor 99 ensures that sufficient fluid remains in supply tank 15 to be distributed to road covers 12; if not, a signal may be communicated to system control module 10 of this fault. Valve body 95 is controlled by magnetic actuator 98, which in turn is in communication with system control module 10. According to the decision algorithm executed by system control module 10, as described above, magnetic actuator 98 is controlled to pass or block the flow of anti-icing chemical fluid through valve body 95, and thus to tubes 92 in road covers 12.

In operation, when system control module 10 polls sensors 85, 86, 87 and, based on their inputs, determines that freezing conditions are present, for example at bridge deck 2 (FIG. 1*a*), system control module 10 issues a signal to magnetic actuator 98 to open control valve 17 and to thus send anti-icing chemical fluids from storage tank 15 to tubes 92. Under the force of gravity, this fluid flows into tubes 92, and exits from orifices 93 at the surface of road cover 12. In addition, passing vehicles driving along road cover 12 briefly compress tubes 92 by their weight, which helps to pump anti-icing chemical fluids out of orifices 93, assisting in the dispensing of these fluids to the road surface. Furthermore, despite tubes 92 only being placed periodically along road covers 12, the action of the contacting tires of the passing vehicles spreads anti-icing chemicals along the surface.

Preferably, system control module 10 executes a dispensing algorithm, responsive to the detection of icing conditions, that is tuned to minimize the amount of anti-icing chemicals dispensed. According to an exemplary implementation, the initial opening of control valve 17 is controlled by system control module 10 so that a preset minimum amount of anti-icing chemical is dispensed over road cover 12, following which system control module 10 again closes control valve 17. Ice sensor 87 is then periodically polled by system control module 10 to determine if the anti-icing chemicals, in combination with the thermal and mechanical anti-icing mechanisms described above, have melted the ice from the surface of road cover 12. If not, system control module 10 will periodically issue a command to control valve 17 to again dispense a controlled amount of anti-icing chemical. The polling, sensing, and command process is then again repeated.

It is further contemplated that, in some conditions, the rate of snowfall may be sufficiently great that the dispensing of anti-icing chemicals becomes futile. In this event, system control module 10 preferably issues a request signal, over its wireless communications facility, to request the deployment of snow removal equipment to its bridge span or roadway portion. Of course, any snowplow must raise its blades by a small amount in order to clear the surface of road cover 12, without damaging it. It is contemplated that, while this plowing action may leave some snow behind, this remaining snow will likely be soaked with anti-icing chemicals, and will thus accelerate the melting process after the snow removal.

According to the preferred embodiment of the invention, various anti-icing chemical fluids may be used, depending upon the desired conditions, upon the chemical budget for road maintenance, and upon environmental concerns. However, as will become apparent from this description, the efficiency in chemical usage resulting from this embodiment of the invention allows use of the most effective and most environmentally benign anti-icing chemicals, despite the relatively high cost. Alternatively, also because of these efficiencies, anti-icing chemicals that are environmentally damaging when overused to the point of runoff, can be used safely in connection with this embodiment of the invention.

As discussed above in connection with the Background of the Invention, there common anti-icing chemicals are the salts of sodium chloride, calcium chloride, and magnesium chloride. These salts all lower the freezing point of water, when placed into solution, and as such, these salts all qualify as anti-icing chemicals. Typically, these chemicals are dispensed in granular form over existing sheets of ice, in a de-icing operation; the salt granules dissolve into any water that is present on the surface of the ice, reduce the melting temperature of the ice, and eventually melt the ice if conditions are suitable. Under conventional methods, various tradeoffs exist in connection with these chemicals, as will now be described relative to this table:

is also contemplated that the construction of road cover 12, including gaps between each of the tubes, provides reservoirs that retain the anti-icing chemicals, reducing the rate of runoff relative to conventional anti-icing chemical methods. As a result, it is contemplated that the amount of anti-icing chemical dispensed by the road cover system according to the preferred embodiment of the invention may be as little as one-fourth to one-eighth of the amount used for a similar length of roadway.

This reduction in the amount of anti-icing chemical can be taken advantage of in one of two ways, depending upon the particular conditions being protected. If environmental restrictions require the least possible impact, or if the lowest possible freezing point is required, magnesium chloride may be used despite its high cost, considering that a much reduced volume of chemical is consumed according to the preferred embodiment of the invention. Conversely, the system of this embodiment of the invention permits the use of calcium chloride and sodium chloride as the anti-icing chemicals to take advantage of their lower cost, because the greatly reduced volume of chemicals used reduces the environmental impact of these chemicals accordingly.

| | Freezing point of $H_2O$ soln. | Relative cost | Corrosivity | Environmental Impact |
|---|---|---|---|---|
| Sodium chloride (NaCl) | −12° C. to −18° C. | Lowest | Corrosive to concrete<br>Not corrosive to asphalt | Increases ground water salinity<br>Damages aquatic ecosystems<br>Leaches toxins from soil into groundwater |
| Calcium chloride ($CaCl_2$) | −29° C. | Low | Corrosive to asphalt<br>Not corrosive to concrete | Elevated concentrations damage small streams<br>Damages aquatic ecosystems |
| Magnesium chloride ($MgCl_2$) | −33° C. | Highest | Much less corrosive than $CaCl_2$ and NaCl | Least toxic<br>Little impact on ground water, surface water, or vegetation |

As evident from this table, magnesium chloride is the preferred salt, due to its low melting point, and its minimal environmental impact and corrosivity, but magnesium chloride is also the most expensive salt.

According to the preferred embodiment of this invention, any one of these salts, in the form of a solution, may serve as the anti-icing chemical fluid distributed through tubes 92. However, it is contemplated that the road cover system according to the preferred embodiment of the invention greatly reduces the amount of anti-icing chemicals used to maintain an ice-free surface. This efficiency results from several effects of this system. These effects include the spreading action of the anti-icing chemicals by traffic, allowing tubes 92 to be spaced apart from one another by as much as six inches to one foot. In addition, road covers 12 are deployed only in the tire tracks of the road surface, further reducing the extent to which anti-icing chemicals are dispensed. Furthermore, the operation of system control module 10 reacts to the presence of ice or conditions conductive to the formation of ice, avoiding the unnecessary anticipatory spreading of these chemicals; in addition, the preferred implementation described above utilizes a programmed dispensing routine that controls the amount of anti-icing chemicals that are initially dispensed, with additional amounts released only upon sensing the continued presence of ice. It Each of the mechanical, thermal, and chemical anti-icing mechanisms, as well as the traction improvement feature, may be used individually, or in combination with one another, to provide efficient anti-icing and de-icing. However, it is contemplated that the use of all of these mechanisms in combination will provide the most efficient anti-icing system, considering that each of the mechanisms reduces the reliance of the anti-icing effort on any one of the mechanisms. For example, the provision of mechanical and thermal anti-icing effects greatly reduces the volume of anti-icing chemicals that need to be dispensed. In addition, the traction improvement provided by the road cover system reduces the extent to which the anti-icing effects must have effect in order to have a safe roadway. Referring now to FIGS. 10*a* through 10*d*, a road cover system according to the preferred embodiment of the invention, and incorporating all of these mechanisms, will now be described. Those elements that were previously described above will be referred to in FIGS. 10*a* through 10*d* with the same reference numerals.

Figure 10A:
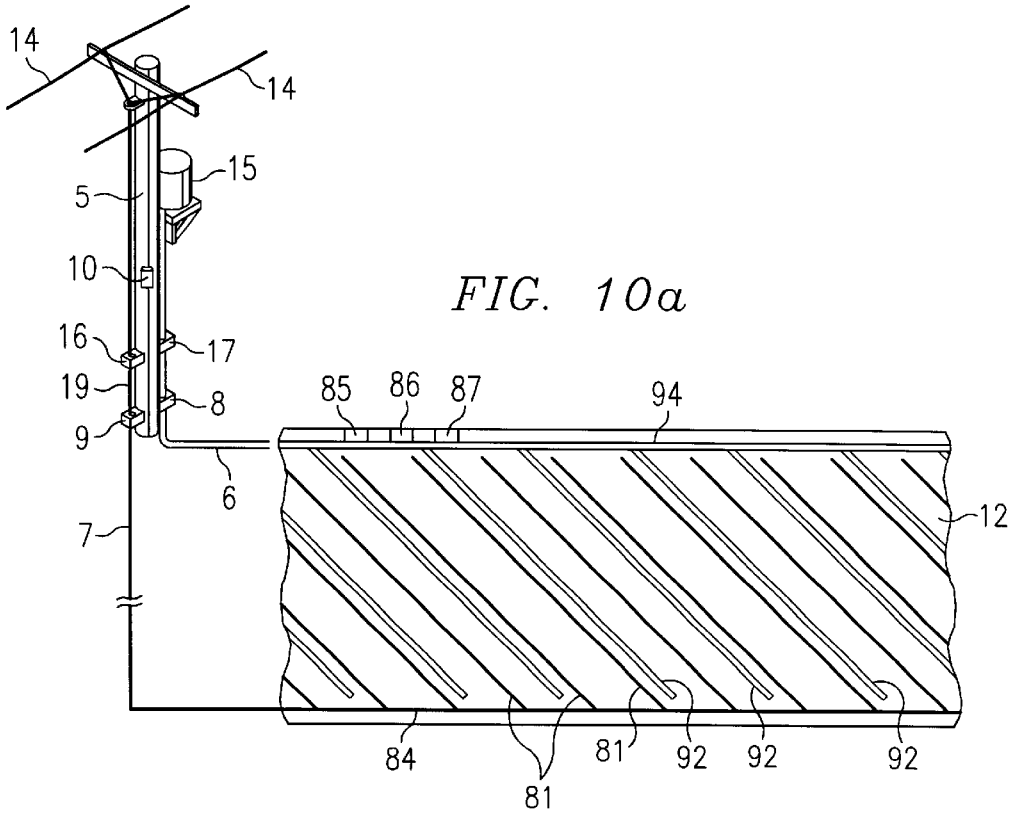
FIGS. 10*a* through 10*d* are elevation views illustrating a road cover including thermal and chemical capability, according to the preferred embodiment of the invention.

As shown in FIG. 10*a*, road cover 12 includes heating coil tubes 81, each of which contain a heating coil 82 (not shown) that is connected to receive current from embedded powered line 84 under the control of system control module 10, as described above. Road cover 12 also includes tubes 92 for carrying and dispensing anti-icing chemicals through orifices 93, as described above, with each of tubes 92 coupled to supply line 94 to receive anti-icing chemical fluids from storage tank 15, also under the control of system control module 10. Sensors 85, 86, 87 are deployed at road cover 12, in the manner described above, responsive to which system control module 10 controls the application of current and anti-icing chemicals, in the manner described above. System control module 10 is preferably programmable by maintenance personnel to operate the anti-icing system to minimize operating costs, to minimize environmental effects, or in a mode that is an optimized tradeoff of these two goals. This programming is contemplated to be performed by the maintenance personnel specifying the sequence of the thermal and chemical anti-icing features. Collapsible tubes 73, disposed between tubes 81 and 92, are deployed in parallel to one another and to tubes 81, 92 (but are not shown in FIG. 10*a*, for clarity). These tubes 73 provide the mechanical anti-icing effects described above.

Figure 10B:
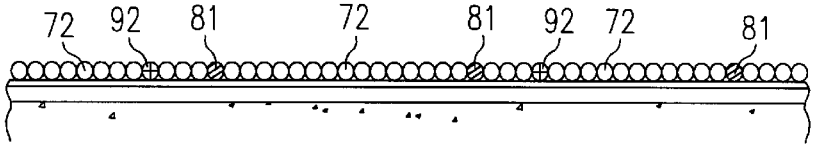

Referring to FIG. 10*b*, the spacing of ridge tubes 72 among collapsible tubes 73, along with heating tubes 81 and fluid dispensing tubes 92 is illustrated in cross-section. In the state illustrated in FIG. 10*b*, the ambient temperature at road cover 12 is above freezing. As such, road cover 12 presents a substantially flat and smooth top surface, permitting comfortable travel thereover.

Figure 10C:
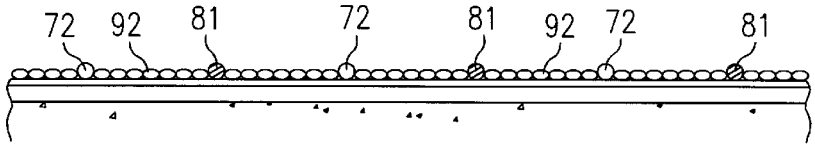

FIG. 10*c* illustrates road cover 12 in its passive operation, upon the temperature falling to freezing or below. Each of collapsible tubes 73 then collapse, for example because of their interior contents changing from a gas state to liquid. Ridges 72 then extend above the surface of collapsible tubes 73, improving the traction of the surface of road cover 12. Heating coil tubes 81 also extend above the surface of collapsible tubes 73, because their interior is filled with heating coils 82 as described above. To the extent that any ice may form over the surface of road cover 12, the deformability of road cover 12 mechanically breaks up this ice, preventing the formation of a dangerous sheet of ice.

Figure 10D:
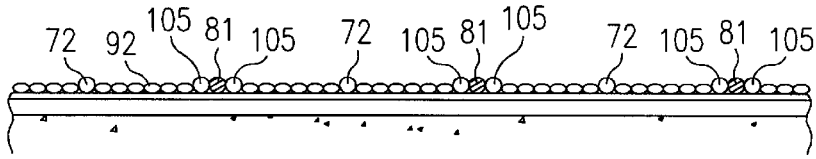

FIG. 10*d* illustrates the state of road cover 12 after ice-forming conditions (precipitation plus freezing temperatures), or ice itself, has been detected by sensors 85, 86, 87. In this state, heating tubes 81 have been energized to heat road cover 12, and neighboring collapsible tubes 105 expand back to their above-freezing, non-collapsed state. In addition, tubes 92 will be dispensing anti-icing chemical fluids, as described above. Ridges 72 remain extending above the surface of road cover, improving traction. All of these mechanisms, including the deformability of tubes 73, are now in action, and will remain so until the ice and ice-conducive conditions are eliminated. Once road cover 12 has been heated to a sufficient temperature, either by heating coils 81 or by the ambient, road cover 12 then returns to its original state of FIG. 10*b*.

The system of FIGS. 10*a* through 10*d* provides a combination of anti-icing techniques that can be optimized for use at any ice-vulnerable and accident-prone intersections. The programmable operation of this system enables it to adjust to rapidly-changing weather and traffic conditions, while maintaining optimal anti-icing performance. It is contemplated that this system accomplishes this performance by the synergistic combination of the mechanical, thermal, and chemical anti-icing mechanisms, because each of these mechanisms serves to reduce the anti-icing burden placed on the others. In other words, the mechanical anti-icing mechanism reduces the thermal energy and chemical volume required, the thermal mechanism reduces the chemical volume required, and the chemical mechanism reduces the thermal energy required. While the system may be operated with no anti-icing chemicals (mechanical and thermal only), or with no electrical energy (mechanical and chemical only), it is contemplated that the best operating point will have some combination of the mechanisms. The favoring of one mechanism over the others can be made intelligently; for example, a roadway located in an environmentally sensitive area can increase the electrical energy used to minimize the use of anti-icing chemicals, while an installation that is more sensitive to cost can increase the amount used of anti-icing chemicals, reducing the electrical energy required. The particular optimum operating point for any given installation will be based on these tradeoffs, as applied to that location.

In operation, the particular anti-icing chemical will be selected for each installation. This selection is contemplated to be made based on the environmental sensitivity of the installation, as well as based on other factors such as anti-icing budget, expected low temperatures, and the like. The constraints of volume of chemical to be used for a given set of conditions can then be used to define the electrical energy parameters for use in the thermal anti-icing mechanism at the same location. For example, the particular anti-icing chemical and its expected concentration when deployed to road cover 12 will determine the demand on the thermal anti-icing portion of the system. By lowering the freezing temperature of water, the anti-icing chemical thereby reduces the temperature to which the thermal anti-icing must heat road cover 12, and therefore synergistically reduces the energy demands. In addition, the thermal heating of road cover 12 assists in the evaporation of the water at the roadway, increasing the concentration of the anti-icing chemical remaining, which further lowers the freezing point and in turn further reduces the electrical energy required to sufficiently heat road cover 12.

It is also contemplated that the combination of the mechanical, thermal, and chemical anti-icing mechanisms according to this embodiment of the invention will have the effect of extending the temperature range over which the system is effective. In other words, the minimum temperature at which icing of a roadway surface can be prevented is contemplated to be reduced according to this embodiment of the invention.

As has been noted throughout the specification, this invention provides many important advantages in the safety of winter road traffic. Anti-icing of roadways, including the particularly susceptible bridge spans and decks, is carried out in an extremely efficient manner by this invention. The automatic mechanical anti-icing approach is passive in that it operates without requiring any intervention by personnel. Traction improvement in cold temperatures is also provided, while still ensuring a smooth ride in warmer temperatures. Upon the detection of ice or ice-conducive conditions, this invention provides an efficient way to apply thermal and chemical anti-icing mechanisms to the prevention of ice buildup. The intelligent control of the application of thermal and chemical effects maximizes their efficiency, and the combination of these mechanisms also reduces the energy and chemical volume required.

This combination of mechanisms also provides multiple backup capability in the event of power outages or materials shortages. The mechanical anti-icing action of the road cover system according to this embodiment of the invention of course does not require any electrical power or consumable materials, and is therefore available automatically in any condition, as a backup. The chemical anti-icing system can be implemented to be controlled and supplied from battery power, making it available in the event of a power failure to perform the anti-icing function in combination with the mechanical anti-icing effect, even if the thermal heating coils are line-powered and cannot be energized. In the event that the anti-icing chemical supply is exhausted, on the other hand, the thermal heating coils can still operate in conjunction with the mechanical anti-icing effect to keep the road surface safe.

In addition, the programmable automated control of the thermal energy and anti-icing chemicals according to this embodiment of the invention permits anti-icing efforts to be applied automatically, without requiring personnel to be deployed to each roadway installation, even in rapidly-changing conditions. This results is contemplated to change the most ice-vulnerable and dangerous locations of public roadways into the safest locations, greatly reducing the frequency and devastating effects of traffic accidents over the entire roadway system. The improvement of traction and reduction of icing conditions is also contemplated to reduce the cost of lost worker productivity that occurs when commuting is slowed because of inclement weather.

In addition, the construction of the road cover system according to this invention is well-adapted to rapid and low-cost deployment during the winter season, and permits its replacement with a corresponding road cover that is well-suited for providing traction in summer months when ice formation is not a concern. This construction also permits the implementation of these important anti-icing and de-icing measures on existing roadways and bridge spans, at a relatively low cost as compared with conventional techniques.

While the present invention has been described according to its preferred embodiments, it is of course contemplated that modifications of, and alternatives to, these embodiments, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. An anti-icing road cover system, comprising:

a pair of base magnetic covers, for attaching to a road surface; and a pair of road covers, for attaching to a road surface; and a pair of road covers, attachable to the pair of base magnetic covers, each road cover comprising:

a magnetic layer, having a width corresponding to a tire track along the road surface; and a tube layer bonded to the magnetic layer, and comprising:

a plurality of parallel deformable tubes, each being collapsible under vehicle weight to a reduced cross-sectional height under the vehicle weight to a reduced cross-sectional height at temperatures below about the freezing point of water; and a plurality of ridge tubes, each parallel to the plurality of deformable tubes, and each of the plurality of ridged tubes maintaining a cross-sectional height, under vehicle weight, greater than the reduced cross-sectional height of the collapsible deformable tubes at temperatures below about the freezing point of water.

2. The system of claim 1, wherein each of the plurality of deformable tubes have an interior containing a material that reduces in volume at temperatures at or below about the freezing point of water.

3. The system of claim 2, wherein the material comprises a FREON refrigerant.

4. The system of claim 2, wherein the ridge tubes comprise a thermo-reactive rubber.

5. The system of claim 1, wherein the plurality of deformable tubes and ridge tubes extend across the width of their corresponding magnetic layer.

6. The system of claim 5, wherein the plurality of deformable tubes and ridge tubes extend obliquely relative to a direction of travel corresponding to the tire track.

7. The system of claim 1, wherein each of the tube layers further comprises:

a plurality of heater tubes spaced among the plurality of deformable tubes, each of the plurality of heater tubes having an interior containing a heater coil;

and further comprising:

a power line coupled to each of the heater coils; and a switch coupled to the power line, for controllably applying a current to the heater coils through the power line.

8. The system of claim 7, wherein each of the road covers further comprises:

a thermal insulator layer, disposed between and bonded to a magnetic layers and corresponding tube layer.

9. The system of claim 8, further comprising:

at least one sensor, deployed near the road surface, for sensing an environmental condition; and a system control module, for controlling the switch to apply current responsive to the environmental conditions sensed by the at least one sensor.

10. The system of claim 9, wherein the system control module includes wireless communications circuitry for communicating with a remote location.

11. The system of claim 8, wherein each of the plurality of heater tubes maintains a cross-sectional height, under vehicle weight, greater than the reduced cross-sectional height of the collapsible deformable tubes at temperatures below about the freezing point of water.

12. The system of claim 1, wherein each of the tube layers further comprises:

a plurality of dispensing tubes spaced among the plurality of deformable tubes, each of the plurality of dispensing tubes having a hollow interior and a plurality of orifices disposed at a top surface thereof;

and further comprising:

a supply line, coupled to each of the plurality of dispensing tubes;

a supply tank disposed above the road surface, for storing anti-icing chemical fluid; and a control valve for controllably gating the fluid to flow from the supply tank to the supply line.

13. The system of claim 12, further comprising:

at least one sensor, deployed near the road surface, for sensing an environmental condition; and a system control module, for controlling the control valve to permit the flow of fluid to the supply line responsive to the environmental conditions sensed by the at least one sensor.

14. The system of claim 13, wherein the system control module includes wireless communications circuitry for communicating with a remote location.

15. The system of claim 13, wherein each of the tube layers further comprises:

a plurality of heater tubes spaced among the plurality of deformable tubes, each of the plurality of heater tubes having an interior containing a heater coil;

and further comprising:

a power line coupled to each of the heater coils; and a switch coupled to the power line, for controllably applying a current to the heater coils through the power line;

wherein the system control module is also for controlling the switch to apply current to the power line responsive to the environmental conditions sensed by the at least one sensor.

16. The system of claim 15, further comprising:

a thermal insulator layer, disposed between and bonded to a magnetic layer and a corresponding tube layer.

17. The system of claim 1, wherein each base magnetic cover comprises a steel plate.

18. The system of claim 1, wherein each base magnetic cover comprises a non-porous flexible magnetic layer.

19. The system of claim 18, wherein each magnetic layer comprises a non-porous flexible magnetic layer.

20. The system of claim 1, wherein each magnetic layer comprises a non-porous flexible magnetic layer.

21. A method of preventing the icing of a portion of a roadway, comprising:

applying a pair of base magnetic covers to the selected portion for a lane of travel, each base magnetic cover corresponding to an expected tire track, the pair of base magnetic covers spaced apart from one another by a distance corresponding to a vehicle wheelbase width; and applying a pair of road covers to the pair of base magnetic covers, each of the road covers comprising a magnetic layer for adhering magnetically to its corresponding base magnetic cover;

wherein each of the pair of road covers comprises:

a magnetic layer; and a tube layer bonded to the magnetic layer, and comprising:

a plurality of parallel deformable tubes, each being collapsible under vehicle weight to a reduced cross-sectional height at temperatures below about the freezing point of water; and a plurality of ridge tubes, each parallel to the plurality of deformable tubes, and each of the plurality of ridge tubes maintaining a cross-sectional height, under vehicle weight, greater than the reduced cross-sectional height of the collapsible deformable tubes at temperatures below about the freezing point of water.

22. The method of claim 21, wherein each of the pair of road covers further comprises:

a plurality of heater tubes spaced among the plurality of deformable tubes, each of the plurality of heater tubes having an interior containing a heater coil;

and wherein the method further comprises:

energizing the heater coil in the plurality of heater tubes.

23. The method of claim 21, wherein each of the pair of tube layers further comprises:

a plurality of dispensing tubes spaced among the plurality of deformable tubes, each of the plurality of dispensing tubes having a hollow interior and a plurality of orifices disposed at a top surface thereof;

and wherein the method further comprises:

applying a liquid anti-icing chemical to the plurality of dispensing tubes, so that the liquid anti-icing chemical flows through the plurality of orifices.

24. The method of claim 23, wherein each of the pair of road covers further comprises:

a plurality of heater tubes spaced among the plurality of deformable tubes, each of the plurality of heater tubes having an interior containing a heater coil;

and wherein the method further comprises:

energizing the heater coil in the plurality of heater tubes.

25. The method of claim 24, further comprising:

sensing environmental conditions conducive to icing at a location near the selected portion of the roadway;

wherein the steps of applying the anti-icing chemical and energizing the heater coil are performed responsive to the sensing step.

26. The method of claim 25, wherein the step of applying the anti-icing chemical comprises applying a selected volume of the anti-icing chemical.

27. The method of claim 25, wherein the steps of applying the anti-icing chemical and of energizing the heater coil are controlled by a system control module.

28. The method of claim 27, further comprising:

programming the system control module with an algorithm for applying the anti-icing chemical and energizing the heater coil.

29. The method of claim 28, wherein the system control module includes a wireless communications function;

and wherein the programming step is performed by communicating from a remote location via the wireless communications function.

* * * * *